US007667131B2

(12) United States Patent
Ierymenko

(10) Patent No.: US 7,667,131 B2
(45) Date of Patent: Feb. 23, 2010

(54) PLAYER TECHNIQUE CONTROL SYSTEM FOR A STRINGED INSTRUMENT AND METHOD OF PLAYING THE INSTRUMENT

(76) Inventor: Paul F. Ierymenko, 2928 Candlehurst La., Raleigh, NC (US) 27616

( * ) Notice: Subject to any disclaimer, the term of this patent is extended or adjusted under 35 U.S.C. 154(b) by 373 days.

(21) Appl. No.: 10/554,480

(22) PCT Filed: Jun. 8, 2004

(86) PCT No.: PCT/US2004/018072

§ 371 (c)(1),
(2), (4) Date: Oct. 24, 2005

(87) PCT Pub. No.: WO2004/018072

PCT Pub. Date: Dec. 23, 2004

(65) Prior Publication Data

US 2006/0243123 A1 Nov. 2, 2006

Related U.S. Application Data

(60) Provisional application No. 60/476,943, filed on Jun. 9, 2003.

(51) Int. Cl.
*G10H 1/06* (2006.01)

(52) U.S. Cl. ..... 84/735; 84/723; 84/726; 84/731; 84/737

(58) Field of Classification Search ..... None
See application file for complete search history.

(56) References Cited

U.S. PATENT DOCUMENTS 3,160,695 A * 12/1964 Bonham ..... 84/706
3,278,672 A * 10/1966 Grodinsky et al. ..... 84/741
3,813,473 A 5/1974 Terymenko
4,075,921 A 2/1978 Heet (Continued)

OTHER PUBLICATIONS

M. Dziubinski and B. Kostek—High Accuracy and Octave Error Immune Pitch Detection Algorithms (2004).

(Continued)

*Primary Examiner*—Marlon T Fletcher
(74) *Attorney, Agent, or Firm*—Myers Bigel Sibley & Sajovec

(57) ABSTRACT

A system for producing music from a stringed musical instrument includes a sensor/actuating transducer arrangement coupled to each or all of one or a plurality of the tensioned strings and supervisory system that governs one or more motion controllers associated with the transducer to affect the string vibration through at least one actuator transducer coupled to the string(s) in accordance with technique commands issued by the player of the instrument, the technique commands being recognized by processes in the supervisor from among characteristics of signal features extracted by further processes continuously analyzing the motional behavior of one or more strings.

50 Claims, 13 Drawing Sheets

U.S. PATENT DOCUMENTS

| | | | | |
|---|---|---|---|---|
| 4,852,444 | A | 8/1989 | Hoover | |
| 4,907,483 | A | 3/1990 | Rose et al. | |
| 5,200,569 | A | 4/1993 | Moore | |
| 5,233,123 | A | 8/1993 | Rose et al. | |
| 5,361,303 | A | 11/1994 | Eatwell | |
| 5,426,720 | A | 6/1995 | Bozich et al. | |
| 6,034,316 | A * | 3/2000 | Hoover | 84/738 |
| 6,216,059 | B1 | 4/2001 | Ierymenko | |
| 6,320,113 | B1 | 11/2001 | Griffin et al. | |
| 6,610,917 | B2 | 8/2003 | Ludwig | |
| 6,662,058 | B1 | 12/2003 | Sanchez | |
| 6,852,919 | B2 * | 2/2005 | Ludwig | 84/735 |
| 2006/0117938 | A1 * | 6/2006 | Gillette | 84/723 |
| 2007/0256551 | A1 * | 11/2007 | Knapp et al. | 84/722 |

OTHER PUBLICATIONS

Udo Zolzer—DAFX: Digital Audio Effects (2002) Ch. 9—pp. 299, 350-357; 362-363.

Udo Zolzer—DAFX: Digital Audio Effects (2002) Ch. 12—pp. 465, 476.

* cited by examiner

Replica of Figure 10 from patent #6,216,059

Pitch Estimation, Spectral Analysis
String Vibration Motional History From Memory 250
200
202
(n = 512)
Autocorrelation
204
206
P
Find Frequency
208
Pitch
Resample
210
Amplitude Feature Extractor
Cycle RMS
Cycle Crest Factor
Cycle Peak
214
212
Fast Fourier Transform
Spectrum
Harmonics
88

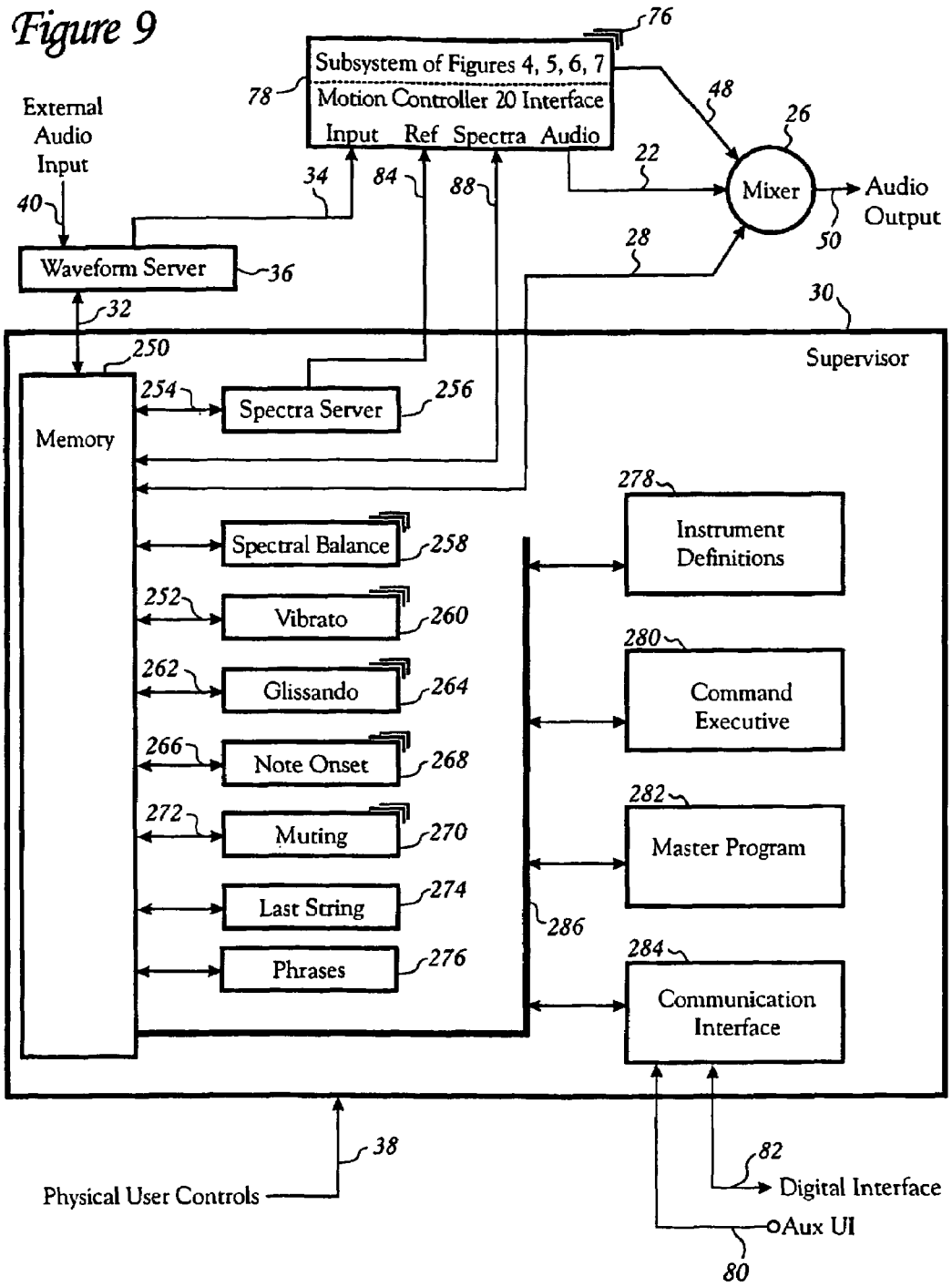
Figure 9
Subsystem of Figures 4, 5, 6, 7
Motion Controller 20 Interface
Input Ref Spectra Audio
76
78
48
26
22
External Audio Input
40
34
84
88
Mixer
Audio Output
50
28
Waveform Server
36
32
30
Supervisor
250
Memory
254
Spectra Server
256
Spectral Balance
258
252
Vibrato
260
262
Glissando
264
266
Note Onset
268
272
Muting
270
Last String
274
Phrases
276
278
Instrument Definitions
280
Command Executive
282
Master Program
286
284
Communication Interface
38
Physical User Controls
82
Digital Interface
Aux UI
80

PLAYER TECHNIQUE CONTROL SYSTEM FOR A STRINGED INSTRUMENT AND METHOD OF PLAYING THE INSTRUMENT

RELATED APPLICATION

This application is based on and claims priority of U.S. Provisional Application Ser. No. 60/476,943, filed Jun. 9,2003, entitled A MOTION CONTROLLED STRING INSTRUMENT for all common subject matter, which the contents of the provisional application are herein incorporated by reference.

FIELD OF THE INVENTION

The invention relates primarily to the art of stringed musical instruments and particularly to man-machine interfaces for use with such instruments. The invention may be used with any stringed instrument. The guitar is often cited herein by way of example, but all aspects of the invention are intended to apply to all fundamentally similar stringed instruments, fretted and unfretted, acoustic and electrified.

BACKGROUND OF THE INVENTION

Prior art stringed instruments have included simple electromagnetic or piezoelectric pickup both with and without signal processing effects and guitar "sustainers" that employ a feedback loop around the tensioned string to produce prolonged notes.

The instant invention differs from or improves upon these known devices and makes possible better sounding stringed instruments that may be more pleasurable to play.

Contrast to Sustain Systems

In a sustainer system, a signal produced by a pickup in proximity to a string is amplified and applied back to the string via a separate actuating transducer, creating feedback that regenerates string vibration. By employing signal processing in this feedback loop, it is possible to achieve some selection and control of the modes of vibration. For example, the sustainer invention of U.S. Pat. No. 5,233,123 ("'123 patent") operates on this principle and has a switch that selects feedback preferential either to the fundamental string frequency or to its harmonics. However, sustainers cannot damp the strings and do not provide precise control over string harmonics.

In a preferred embodiment and as pointed out in U.S. Pat. No. 6,216,059 ("'059 patent"), the controller operates a single transducer as a sensor during the first part of a time frame and as an actuator during the second part of a time frame such that sequential repetition of said time frame produces a piece-wise approximation to continuous control.

An embodiment of the invention is operable with a simple sustainer, but provides fewer benefits than preferred embodiments employing motion control, as it is unable to precisely damp vibration or control timbre.

Definition of Terms

The term "sensing/actuating transducer" refers to a transducer system (e.g., one or more transducers) capable of providing an output signal in accordance with the motion of the string and capable of affecting a change in the string's motion in response to an actuating signal. Preferably the sensing/actuating transducer is a single unitary transducer as described in my '059 patent.

The term "controller" refers to a system, e.g., of the type described in my earlier '059 patent, which receives output signals from the sensing/actuating transducer and control signals, e.g., reference signals and applies actuating signals to the sensing/actuating transducer to modify the motion of the string.

The term "supervisor" refers to a supervisory system with signal storage facilities and data processing capabilities capable of interpreting certain input from the user referred to as preselected player techniques in the form of selected characteristic features of the string's motion via the sensed output signals and provides control signals to the controller to govern the behavior of the controller accordingly. It is to be noted that the controller and supervisor need not be in the form of separate components and that some functions may be interchanged.

The term "timbre" refers to the harmonic spectrum of a note.

The term "techniques" refers to actions every guitarist learns to perform to achieve a certain nuance or effect in playing his instrument. Playing techniques include but are not limited to vibrato and glissando or bending of the string, muting the strings, and various styles and methods of plucking and muting the strings such as the deliberate touching of harmonic nodes of strings.

The term "control signal" refers to any signal used to control something.

The term "technique command" refers to a control signal that represents the deliberate will of the instrumentalist, much as if he had turned a dial or closed a switch. Technique commands are also referred to herein according to the type of technique used to issue them, i.e., a "vibrato command" or a "glissando command". Note that most such commands are continuous in both magnitude and time. For example, when an instrumentalist uses vibrato to control the invention it is akin to riding a joystick as against flipping a switch.

The term "recognition" is used herein to convey the idea of a system mimicking a human cognitive process, in that the system recognizes a human player's intent encoded in the characteristics of the musical signal created by the player.

The terms "path" or "data path" refer to a virtual or physical digital communication connection that is understood to be capable of carrying mixed data including a plurality of signals in both directions.

The term "time frame" refers to the time taken to iterate the control loop once, i.e., the time between one sensing event to the next, i.e., the reciprocal of the control system sample rate with respect to the use of a unitary transducer as descried in the '059 patent.

The term "muting" refers to an action performed by the instrumentalist and can be a technique command.

The term "damping" is performed by a motion control system. Damping may be the response to a muting command of technique.

The terms "musician", "player", "guitarist" and "instrumentalist" are used interchangeably and should herein be taken to mean, "the player of any stringed instrument".

Overview of the Invention

The invention combines means to sense and influence the vibration of guitar strings together with a novel method of user control, that of extracting and interpreting the guitarist's playing techniques as purposeful user commands.

The means of sensing and influencing strings comprise at least one sensing/actuating transducer coupled to each string to be controlled for sensing the motion and for effecting a change in the motion of the string via a supervisor/control system in response to recognized player techniques.

The skilled guitarist already uses techniques as commands given to his conventional instrument. For example, when he desires vibrato, he "commands" it, usually by slightly modulating the tension of the string with his fretting hand. In the instant invention, such playing techniques are recognized by a supervisor and interpreted as user commands to the electronics of the invention. According to the invention, by means of such playing techniques the instrumentalist controls electronic parameters that are otherwise often controlled through cumbersome ancillary interfaces such as switches, dials, foot pedals and the like.

The invention employs the known concept of feature extraction where features of vibrations including but not limited to amplitude, pitch, spectra, note onset and mute are continuously recorded and analyzed to identify musical playing techniques as commands. For example, pitch is analyzed over time to recognize and quantify vibrato and a corresponding vibrato command signal is issued. Such command signals either serve directly as inputs to the vibration influencing means or they alter the selection of inputs to said means.

These combined elements of the invention empower the guitarist to use playing technique to affect the vibration of the strings of his instrument to a far greater and more varied extent that was available to him before the invention. He can sustain notes or chords at will, mute notes more easily, and produce a variety of timbres and harmonic effects never before possible. He can hear the sounds produced both acoustically and with amplification, and he can control everything directly as he plays, without resorting to a multitude of switches, dials and foot pedals.

Objects/Embodiments of the Invention

Recognition of Technique Commands.

The general concept of controlling digital audio processing effects by means of control signals derived from features of the sound itself or from other sounds is known. See P476 of the book entitled DAFX-Digital Audio Effects published by John Wiley & Sons Ltd.© 2002 ("DAFX"). That concept has been applied to music synthesizers and effects devices that process audio signals. An object of the instant invention is to build upon the concepts of feature extraction and analysis to extract intentional commands from an instrumentalist's purposeful technique. When combined with a means to influence string vibration in accordance with said commands, this constitutes a unique apparatus and new method of a musical instrument.

Motion Control System with Full Harmonic Control

A preferred embodiment of the invention provides means to sustain independently upon each tensioned string of an instrument the vibration of some selection of harmonics while simultaneously damping some other selection of harmonics, said selections being governed by a reference spectrum. The '059 specifies such means. This and any other such means, when coupled with a user command interface responsive to playing techniques would fall within the scope of property of the instant invention.

Waveform Reference Signal

In an aspect of preferred embodiments of the invention, generated or stored time domain waveform signals are applied as reference actuating signals to excite vibrations upon the associated string or strings.

Time and Frequency Domain Reference Signals

A preferred embodiment of the invention uses both time-domain and frequency domain reference inputs. The motion control system of the '059 patent provides for both time-domain and frequency domain reference inputs.

Damping Open Strings

A preferred embodiment of the invention interprets and extends a guitarist's muting technique to actively damp sympathetic vibrations occurring on unplayed "open" strings to silence unwanted sounds.

Electronic String Excitation

A preferred embodiment of the invention provides means to electromagnetically "pluck" or otherwise excite string vibration where none exists.

Mute Technique as a Command Signal

A preferred embodiment of the invention recognizes the instrumentalist's intentional acts of muting the strings and provides a technique command signal therefrom.

Vibrato Technique as a Command Signal

A preferred embodiment of the invention derives a technique command signal from vibrato technique. The guitarist applies vibrato technique when he "shakes" or bends a string back and forth with his fretting hand to make the pitch waver or uses a vibrato arm.

Vibrato Rate Technique as a Command Signal

In a further embodiment of the invention, the rate of vibrato is measured and extracted as a command signal.

Glissando Technique as a Command Signal

A preferred embodiment of the invention derives command signals from upward and downward glissando.

Vibrato and Glissando Control Sustain and Timbre

In preferred embodiments of the invention, the magnitude of the Vibrato command signal governs the intensity of the sustain effect while the Glissando command signal governs timbre, or the reverse, or one and not the other.

Note Onset Amplitude Technique as a Command Signal

A preferred embodiment of the invention derives a command signal from the greatest amplitude detected when a new note is struck.

Note Onset Spectrum as a Reference Spectrum

A preferred embodiment of the invention derives a reference spectrum from the spectrum of the note as measured at the instant the string is struck by the guitarist.

Spectral Balance Command Signal

A preferred embodiment of the invention derives a command signal from the normalized spectral centroid of the string vibration. See page 362 of DAFX. This signal measures how the spectral energy of string vibration is distributed between high and low harmonics. Such a control signal approximately indicates where in relation to the bridge the string was struck.

One embodiment of the invention uses the harmonic balance command signal as a key that selects a particular reference spectrum from a stored palette of spectra. Thus, by striking a note a certain way or at a certain point on the string, the player can invoke a certain timbre.

Last String Played Command Signal

A preferred embodiment of the invention has a mode where only the last string played is permitted to vibrate while the rest of the strings are actively damped. In this mode, it is possible to play arpeggios by holding and strumming chords, even on an acoustic instrument.

Pitch Correction Aspect

In a preferred embodiment of the invention, there is a user-selectable aspect that acts to pull the pitch of each note towards a stored pitch standard such as an equal tempered scale. As the tensioned string is part of a harmonic oscillator, by the action of the motion control loop, the pitch of the string can be pulled a few cents in either direction from its natural pitch by said control system, permitting minor tuning errors and errors of glissando to be corrected.

Recording of String Attributes and MIDI Output

In a preferred embodiment of the invention, vibration feature history in memory is analyzed and expressed as a MIDI or other standard protocol for controlling and communicating with other audio equipment for the purpose of controlling said equipment or of turning a performance into a musical score, i.e., automatic transcription.

Phrase Recognition Command Signal

In a preferred embodiment of the invention, phrase recognition is used in conjunction with a simple switch to invoke modes of the invention. Recently recorded pitch history of the strings is reviewed and compared against deliberately recorded sequences of pitch herein called a "command phrase". The guitarist uses said switch to invoke a temporary phrase-recognition mode of the invention when he desires to enter a musical command phrase. He then enters one or a series of notes. The entered phrase is compared against stored command phrases. When a matching sequence is found, the system responds by entering the mode of operation associated with the sequence, thereby executing a phrase command.

Techniques Used in Combination

In preferred embodiments of the invention, the various playing techniques and the command control signals they generate can be used in any useful combination to control various aspects of the invention's behavior at once.

In preferred embodiments of the invention the value of one control signal can optionally change the value, polarity or curvature of a second control signal.

Basic Physical Controls

In a preferred embodiment of the invention, the guitarist interacts with a minimum number of easily accessible manually operable physical controls. The controls may be of any suitable kind such as a touch-sensitive area, capacitive, mechanical, etc.

In a preferred embodiment of the invention there is a physical control for switching from one mode to another mode of the invention, a physical level control to set the level of the electrical audio signal output from the invention, and a physical control to turn off and on the invention's electronics. There is also an optional touch-sensitive area for selecting along an x-axis the harmonics to be influenced or optionally the strings to be influenced and for controlling along a y-axis the degree of sustain and muting. Other embodiments of the invention may have more physical user controls.

Defining an Instrument by Mapping Technique Command Signals to Control System Behaviors.

In a preferred embodiment of the invention, a control mapping matrix is bounded on one axis by all possible technique-derived control command signals and along the other axis by all possible system behavioral inputs. Using a Manufacturer's Setup Utility software, selected functions or "scripts" can be inserted at any subset of cross points in the matrix for the purpose of establishing the relationship between particular command signals and particular behavioral inputs. The mapping and scripts of all such elements together with sets of reference waveforms and spectra constitutes an "instrument definition". For example, an instrument definition of a guitar would be one set of waveforms, spectra and scripts and a banjo would have another.

Instrument Definition Design Utility Software

In a preferred embodiment of the invention, as a means of setting up the instrument rather than of playing the instrument, a "Manufacturers Set-up Utility" computer program running within the invention or on any suitable external computer connected to the invention through a communication link enables a manufacturer or instrument designer to define the character and behavior of a particular model or brand of an instrument employing the invention. Said behavior is established by prescribing the assignment and interrelationship of the various technique-derived command signals and by supplying and storing unique reference spectra within the electronics of the invention. Thus one manufacturer who develops a product for sale that employs the instant invention can differentiate his product from all others by developing his own prescription for control behaviors and endowing the instrument with his own choice of sounds, all without modifying a standardized hardware apparatus of the invention.

Use With Known Sustain Systems

Reduced but still novel and musically useful functionality is obtained by coupling the "Recognition of Technique" aspect of the invention with existing sustainer systems.

In a preferred embodiment of the invention, a control signal representative of vibrato could be used to control the amount of sustain delivered to a string by a conventional sustain system such as the sustainer described in the '123 patent provided that this sustainer was modified to accept such a control signal input governing its sustain action.

All such uses are anticipated in the instant invention and would fall within its scope of property.

Additional User Interfaces

A further embodiment of the invention accepts, via an auxiliary user interface connection, mode or behavioral control signals from an auxiliary user interface.

Plurality of Instrument Definitions

In a preferred embodiment of the invention a plurality of instrument definitions is stored within the each instrument according to the invention. A change of mode is required when changing from one definition to another. This is conceptually equivalent to putting down one instrument and picking up another.

Computer Interfaces

In a preferred embodiment of the invention, means are provided to download, store and upload internal states of the instrument. Such state records can be stored, examined and edited on a computer. Aspects of the instrument's behavior can be customized in this way. Another use of this facility is to transfer instrument definition settings from one instrument to another, or simply to back up the settings in case the electronics of the instrument fail or the instrument is lost or stolen.

In a preferred embodiment of the invention the external computer interface of the invention has the capability of downloading replacement computer and digital signal processing executable computer code for all internal programs of the invention. This code downloading feature makes it possible to correct programming errors and to advance the art of the electronics without having to change physical components within the instrument. Within the invention, a kernel of persistent code that cannot be overwritten provides this basic communication and code download functionality.

Audio Interfaces

In preferred embodiments, audio input and output is handled both as an analog signal and in standard digital formats.

Secondary Pickup Set

In an alternate aspect of all embodiments, the outputs of a set of individual string bridge pickup transducers are digitized and analyzed to extract string attributes, either instead of or in conjunction with the sensor channel outputs of the motion control transducer. A bridge pickup responds to all planes of vibration of the string whereas a magnetic pickup deployed beneath a string senses only the normal components of string motion. Using the outputs of the secondary pickups for analysis does not violate the fundamentals of the control system of the '059 patent; as before, the unitary transducer performs all frame-by-frame motion control activity.

In a preferred embodiment, the secondary pickup is of a type that does not respond to the electromagnetic field of the control transducer.

Orthogonal Transducers

In a preferred embodiment of the invention, there may be two control systems and two transducers coupled to each string of the instrument, where the transducers are arranged orthogonally so that a string vibration in a plane parallel to the face of one transducer will be normal to the face of the other, this arrangement providing for improved control of all string vibrations. This and other combinatorial variations and arrangements of transducers are anticipated and all fall within the scope of the instant invention.

External Audio Signal as a Spectral Reference

In a preferred embodiment, there are one or more audio inputs that accept either analog signals or signals in a standard digital form. Any audio signal, including sounds from any synthesizer, can be applied to such inputs. The spectra of these audio inputs are continuously extracted using Fourier methods and can optionally serve as a "live" or "real time" spectral references, allowing for example an instrumentalist's voice to control the timbre of the instrument. When an audio input is present, it automatically overrides other spectral references.

Physical Deployment in an Instrument

A preferred embodiment of the invention incorporates and integrates the electronics of the invention with an acoustic instrument or solid body instrument so as to create a new instrument that to the player seems as a unified whole rather than as an instrument with attached electronics. An electronic subsystem containing some or all of the required functions of the invention replaces the bridge and saddle of a conventional instrument. If needed, a second subsystem of the invention is housed inconspicuously within the instrument body.

SUMMARY OF THE INVENTION

A system for modifying the vibration of at least one string (and preferably each string) of a stringed instrument in response to preselected player techniques involving selected characteristic features of the string's motion includes, at least one transducer, coupled to the string for providing a sensing output signal in accordance with the motion of the string and for effecting a change in the string motion in accordance with an actuating signal. Preferably the transducer (or orthogonally arranged transducers) is of the unitary transducer type as described in the '059 patent. The sensed output signals are stored in a memory to provide a history of the string's motion and features of such motion are extracted. A supervisory system, which may include the memory, reviews the extracted features to determine when said features substantially correspond to one or more preselected player techniques. In response to the recognition of a preselected player technique(s) the supervisor provides a control signal to a controller, which in response thereto and applies an actuating signal to the transducer to modify the string's motion in accordance with the recognized technique. For example, a set of pattern matching rules representative of string motion associated with the preselected player techniques, allows the extracted features to be tested against the rules. A programmer may establish and record the rule set, e.g., at a manufacturing site, or the rule set may be generated and recorded by the supervisory system during a training session depending upon the processor architecture employed. The preselected player techniques may include vibrato, glissando, etc. Additionally, a waveform server may be provided for supplying excitation waveforms to the controller, and the supervisory system may provide for storage and retrieval of spectral templates as well as a general storage means for retaining system data. A battery or fuel-cell and recharging means or wire connection means may be included for supplying power to the system of the invention during use. Analog and digital data and audio inputs and outputs may also provided for connecting the instrument to other electrical devices such as an external user interface device, computer or an audio amplifier.

BRIEF DESCRIPTION OF THE DRAWINGS

FIG. 9 is a block diagram showing details of the supervisor;

In all figures, except FIG. 9, elements that are replicated for each string but are otherwise identical are subscripted. In the text these subscripts are used only when it is necessary to differentiate between instances of an element. If no subscripts appear, then the material is intended to apply equally to all instances of the element.

Exclusion of Ordinary Details

Routine aspects of software and hardware known to one with ordinary skill in the art of designing digital signal processing systems as being necessary to the functioning of such software and hardware systems are not described herein. As a partial example, such things as software stacks, buffering and scaling amplifiers, hardware clocks, memory controllers, DMA, etc., are assumed obvious and not shown or described herein for clarity. Conversely, wherever ordinary details are included herein, it is done for clarification and does not impose a duty to include such details throughout.

DETAILED DESCRIPTION OF THE INVENTION

Patents Included by Reference

The control system used in the preferred embodiment of the instant invention is described in the '059 patent and the contents of the patent are incorporated herein by reference. The descriptions and waveforms presented in the '059 patent are applicable to the instant invention. The '059 patent incorporates signal processing to extract spectra from a string's motional signal, to compare said spectra to a reference spectra, and to adjust a control function to compel the string's motional spectra to match the reference spectra.

The '123 patent provides an extensive examination of basic sustainer technology and the contents thereof is included herein by reference.

U.S. Pat. No. 3,813,473 ("'473 patent") shows an early sustainer system using mechanical feedback and the contents thereof are also included herein by reference.

The Supervisor

The instant invention introduces an apparatus and method (known herein as the "supervisory system" or "supervisor") for recognizing the intentions of an instrumentalist and responding in the form of specific control system behaviors. The supervisor captures information from all strings of the instrument over time and governs the actions and behaviors of all the individual motion controllers according to the instrumentalist's intent.

The Transducers

All figures herein show transducers as simple solenoids. It is understood that all known transducer types, shapes and configurations that will comport with the operating principles of the invention can be substituted for the transducers shown herein and shall fall within the scope of the invention.

FIG. 1

Figure 1:
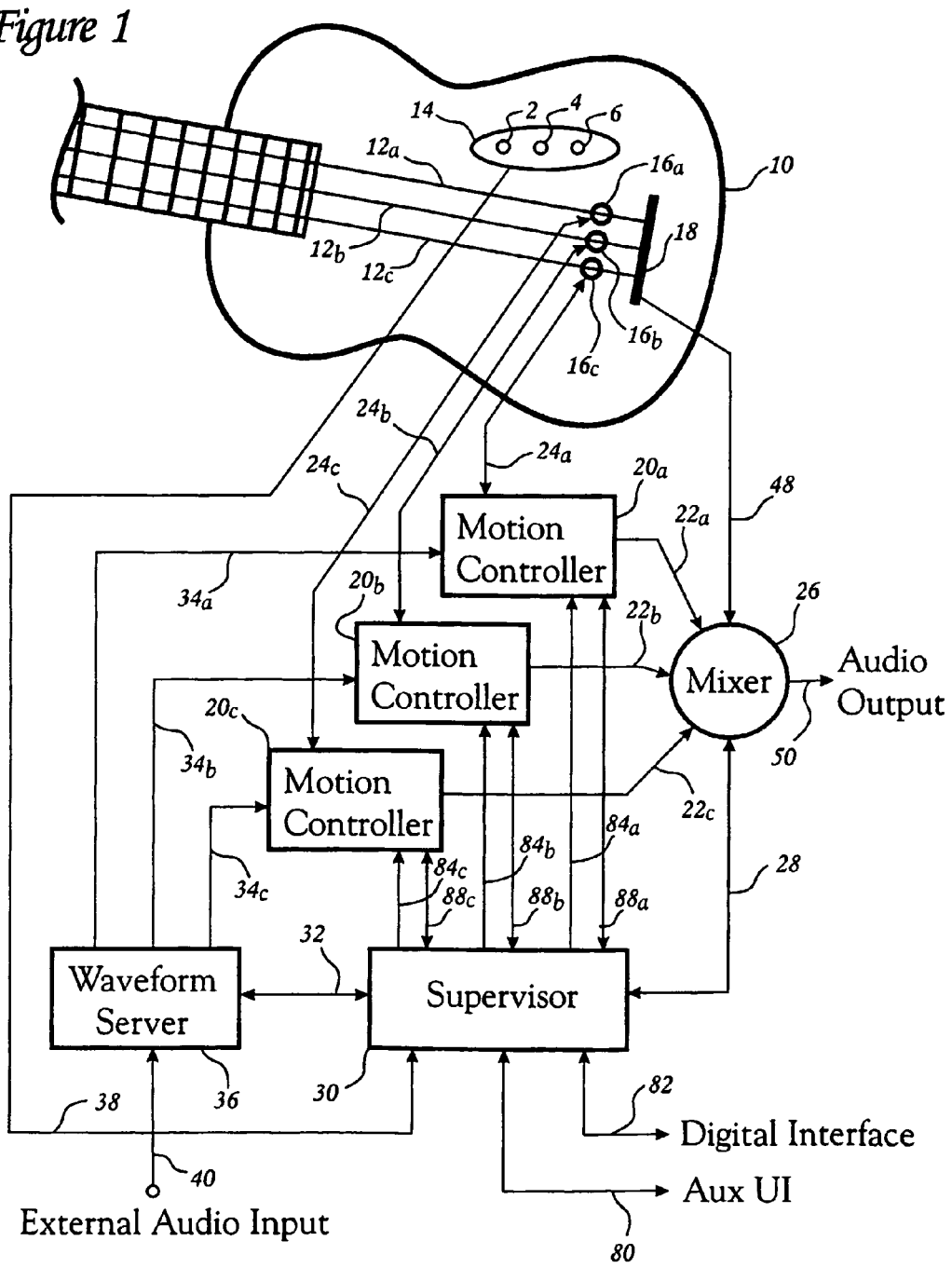
FIG. 1 is a block diagram of the basic elements of the invention connected to a guitar-like stringed instrument.

A preferred embodiment of the invention is shown in FIG. 1. It is sufficient to show guitar 10 as having three strings 12*a-c* but it could have any number of strings 12. The number of motion controllers 20 would follow the number of strings.

Strings 12 are anchored and tensioned between bridge 18 and any suitable fixture such as tuning pegs at the end of the neck. In close proximity to strings 12 are pickups 16. User controls 14 are positioned on the instrument for convenient access and can be of any suitable design including touch surfaces, rotating or sliding potentiometers, switches and etcetera.

In FIG. 1, bridge 18 may optionally have a piezoelectric or other kind of pickup that responds to string vibration but not to the electromagnetic actuating fields produced by pickups 16.

FIG. 1 shows the invention in conceptual form. Interconnection lines represent the flow in information but not necessarily physical connections. Accordingly, routine aspects of processing systems such as analog to digital and digital to analog conversion stages are not shown. Communication lines 22, 28, 32, 34, 82 and 88 are shown for conceptual clarity as proceeding from one function block to another, whereas the actual paths of such information within the system of the invention may pass through a memory subsystem, also not shown in FIG. 1. The more abstract functional objects shown are realizable in hardware, software or both.

Mixer 26

In mixer 26, audio outputs 22 are selected and mixed with an optional bridge pickup signal 48 to produce electrical output signal 50. Signal 50 may be a stereo or multichannel signal, and can be in any form including digital and optical. Supervisor 30 communicates with mixer 26 over path 28 and can exchange time or frequency domain data and control all mixer parameters. Mixer 26 routes instantaneous waveform data 22 and 48 for storage in memory 250 of the supervisor, (see FIG. 9).

Motion Controllers 20

Motion controllers 20 are of the type presented in the '059 patent, which is a unitary transducer control system having a "reference" terminal that governs the amplitude and harmonic spectrum of a vibration and an "external input" terminal that accepts time domain reference waveforms to excite vibration. Minor aspects of the '059 invention have been reconfigured for integration into the instant invention as will be presently described.

Referring to FIG. 1 of the instant invention, each pickup 16 is connected to a motion controller system 20. Each motion controller system 20 is configured to accept a time domain input 34 and a frequency domain reference input 84, and to provide an audio output 22 and a frequency domain output on data communication path 88 representing the most current pitch and spectra of string vibration.

The spectral and time domain inputs can be used in conjunction. For example, a time domain input can excite the string across a broad harmonic spectrum and the spectral reference input can cause unwanted harmonics to be selectively damped.

It is understood that a spectral reference signal conveys the amplitude target of every partial of note vibration and therefore also controls overall note amplitude.

Waveform Server 36

Waveform server 36 delivers specified time domain waveforms to the time domain reference inputs of motion controllers 20. This input corresponds to that labeled "Ext. Input, 154" in FIG. 10 of the '059 patent. Said waveforms may be prerecorded in supervisor 30 or the waveform server may synthesize them as needed, or they may be provided externally over audio path 40, whereby waveform server 36 is equipped to accept external analog or digital audio signals. Waveform server 36 has a communication path 32 for exchanging waveform and control data with supervisor 30.

Supervisor 30

Figure 10:
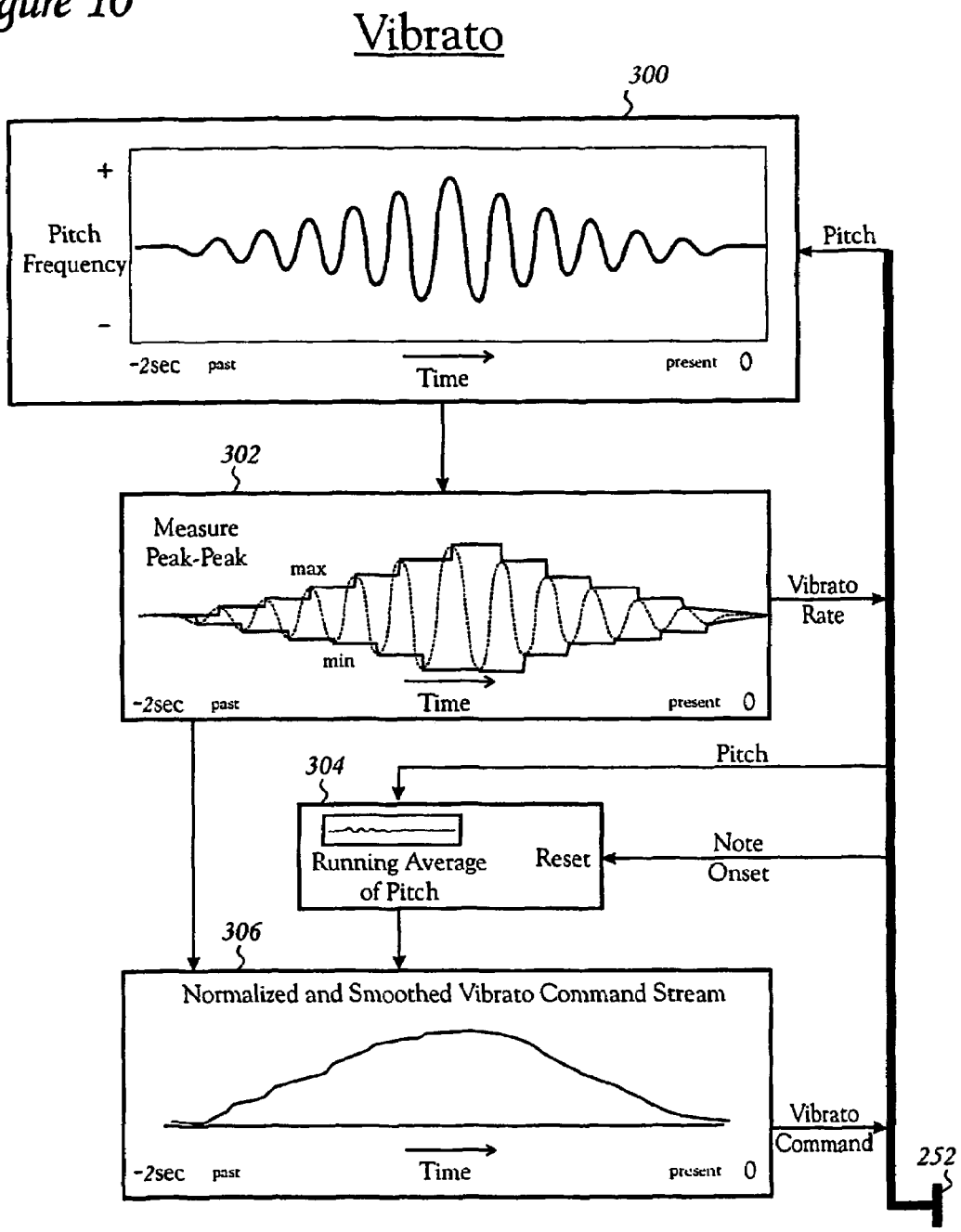
FIG. 10 is a graphic depiction showing the vibrato technique recognition process.

Supervisor 30 delivers spectral reference, data and control signals 84 to an input of motion controllers 20 corresponding to that labeled "Reference, 156" in FIG. 10 of the '059 patent. Data path 80 connects the supervisor to an optional auxiliary user interface. A digital interface 82 connects the supervisor to a data network or to a computer. Supervisor 30 controls mixer 26 via data path 28. Supervisor 30 accepts real-time spectral information about strings 12 from motion controllers 20 on data lines 88, and it provides reference spectra to the motion controllers on path 84. The supervisor also exchanges mode control instructions and status information with motion controllers 20 via lines 84 and 88.

Manual controls 14 communicate control signals to supervisor 30 over path 38 and include, but are not limited to, a on/off switch 2, a mode switch 4, and a level adjustment 6.

Guitar 10, bridge 18, strings 12 and transducers 16 are all physical objects. Manual controls 14 may be purely physical, i.e., mechanical switches, or they may be realized as an LCD touch screen or other advanced interface. Each motion controller 20 has physical power electronics for the purpose of applying power to its transducer 16 and has physical sensing electronics for reading the transducer output signal. All other aspects of FIG. 1 are realizable using any suitable programmable device including but not limited to a computer, a digital signal processor and a programmable logic device.

Parallel Control Systems

Any number of motion controllers 20 can be operated in parallel proximity providing that their timing is aligned and synchronized. When the timing is aligned, each controller delivers its actuation pulse at a first same time as all others and all controllers sample their input channels at a second same time. Each sensing channel is thereby time-isolated from both its own actuating channel and from the actuating channels of adjacent controllers.

FIG. 2

Figure 2:
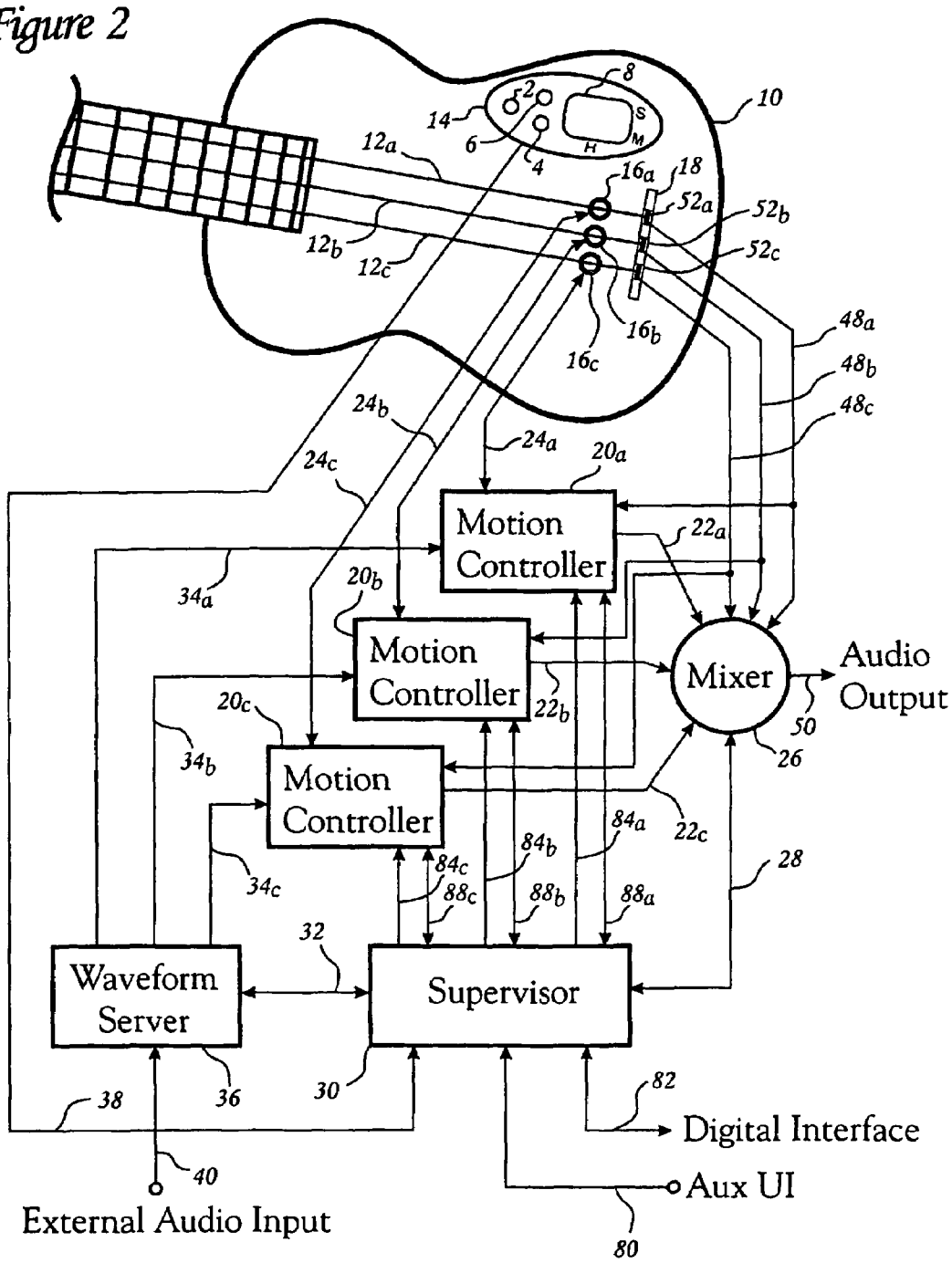
FIG. 2 is identical to FIG. 1, except for individual secondary string pickups.

In a preferred embodiment, FIG. 2 serves instead of FIG. 1. FIG. 2 is identical to FIG. 1 except for individual string bridge pickups 52, which are of a type responsive to all planes of string vibration but not to electromagnetic actuating fields, a divided piezoelectric bridge pickup being one such type and except for an optional control area 8 within manual controls 14 that is operated by a player's fingers and which provides an x-axis for selecting and manually commanding excitations upon strings in a first mode or selecting harmonics in a second mode, and controlling a continuum between muting and sustaining along the y axis in both modes.

String vibration signals 48 from pickups 52 are sent to the analysis inputs of motion controllers 20 and to mixer 26.

In FIG. 2, motion controllers 20 are configured to accept signals 48 for spectral analysis rather than sensing channels signals from the unitary transducers.

FIG. 3

Figure 3:
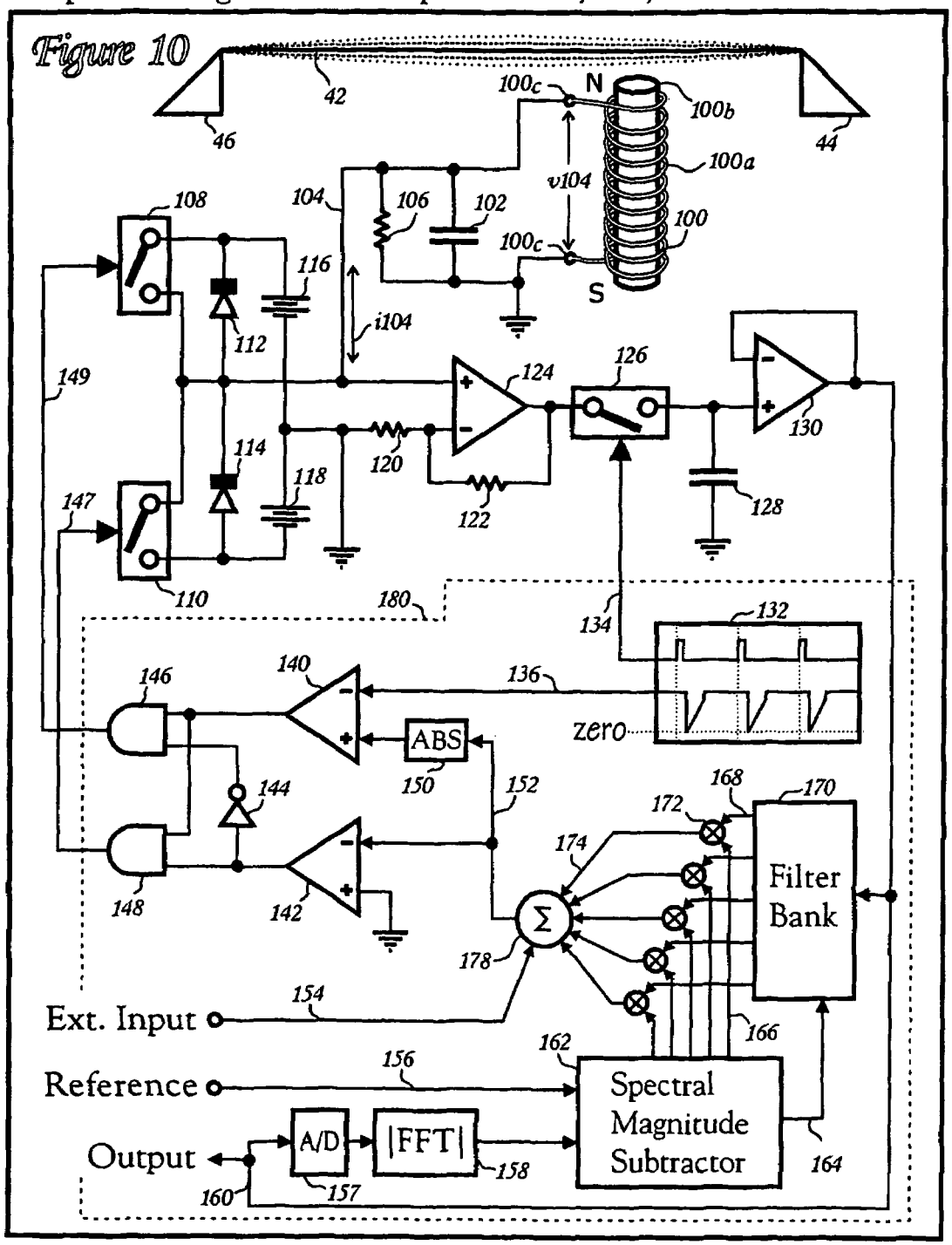
FIG. 3 is a block/schematic diagram of a controller depicted in FIG. 10 of the '059 patent.

FIG. 10 of the '059 patent is reproduced here as FIG. 3.

FIG. 4

Figure 4:
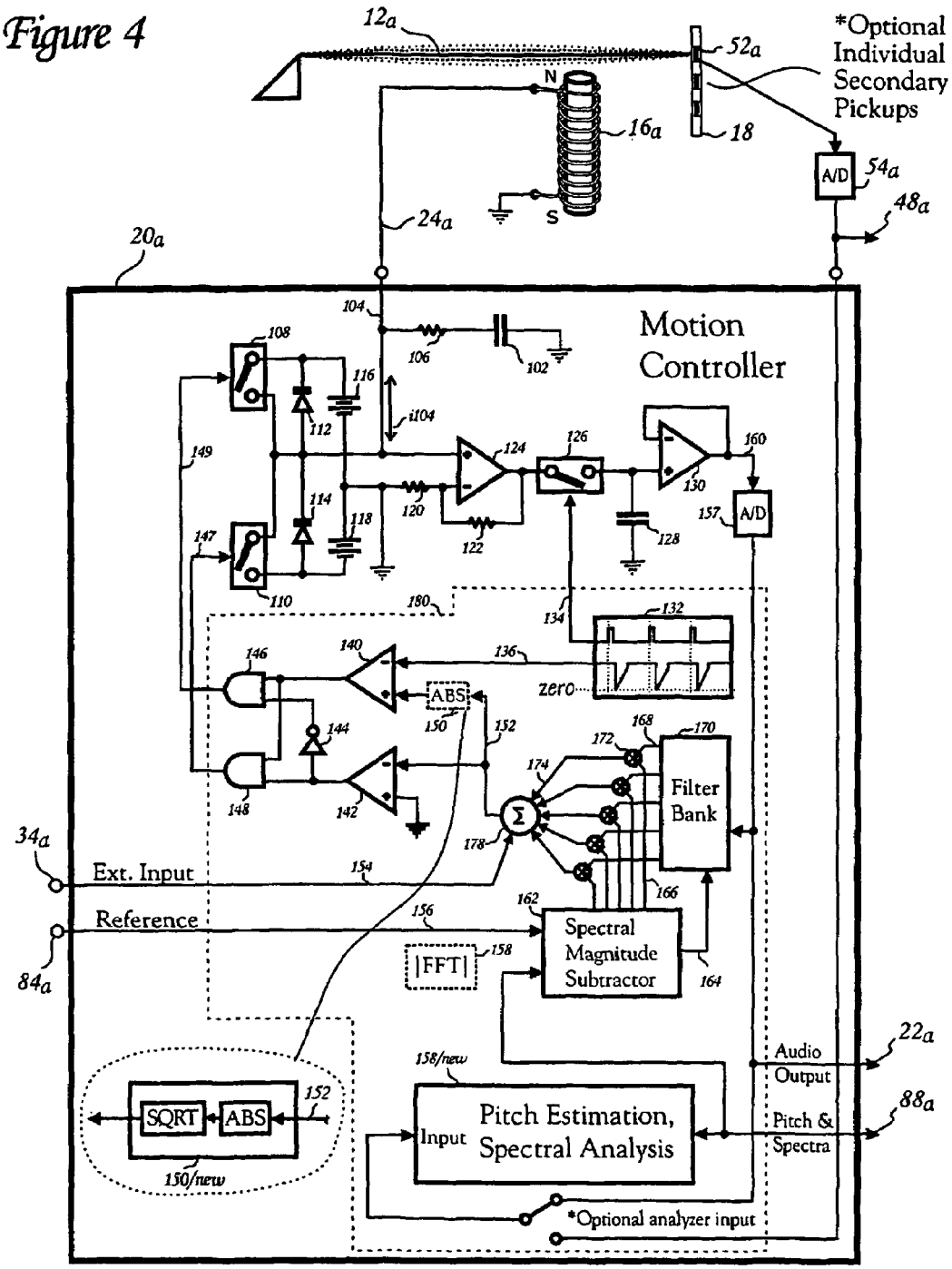
FIG. 4 is similar to FIG. 3 with the input to the actuator linearized by a square root calculation.

FIG. 4 shows the modifications made to FIG. 10 of the '059 patent to configure the '059 control system for use in the instant invention. Motion controller block 20*a* is detailed but all such controllers 20 are understood to be identical.

The portions of the functionality within a block 20 may be realized by entirely digital means. The functionality of the pulse width modulator portion may be realized as a digital pulse width modulator. Such implementation options will be apparent to one with ordinary skill in the art.

Reference designators within block 20*a* are those of the original FIG. 10 of the '059 patent. Reference designators outside of block 20*a* are of the instant invention.

Block 150/new contains an absolute value calculation followed by a square-root calculation. The maximum signal amplitude is assumed to be one unit and thus is unchanged by the square-root function. The '059 patent uses a pulse width modulator having a discontinuous output current. Such modulators are known to have a square law transfer error. The force integral applied to the string in each time frame is proportional to the square of the pulse width during that time frame whereas is desirable that it should be linearly proportional. By replacing block 150 with block 150/new as shown, this transfer error is eliminated.

If an optional bridge pickup having individual pickups for each string is present, analog to digital converter subsystems 54 are also present, of which A/D 54*a* is illustrated. A/D 54*a* digitizes the bridge pickup signal for compatibility and is preferentially of a fast instrumentation type rather than a sigma-delta type.

As an example of the routine exclusion of ordinary details, it would be obvious to one with ordinary skill in the art that the A/D 54 subsystem must contain analog pre-amplification responsive to the high impedance output of a pickup 52 to present a correctly scaled, low impedance signal to an analog to digital converter. It is understood that this one example serves for the entire instant document wherever other details of a similarly routine nature are omitted.

Old block 158 is replaced by 158/new, a pitch estimator and spectrum analyzer that can be configured to accept input data originating from either signal 22*a*, the sensor time channel of the unitary transducer, or from 48*a*, the signal from secondary bridge pickup 52*a*, provided that the particular embodiment has such a bridge pickup.

Motion controller 20*a* provides the most current pitch and spectra of string 12*a* on data path 88*a*. Within block 20*a*, snubber components 106 and 102 are transposed to a series rather than parallel arrangement for lower thermal loss.

Figure 5:
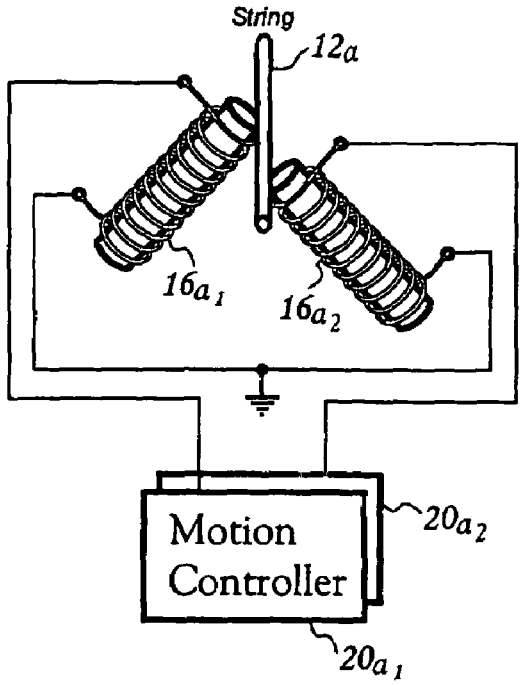
FIGS. 5 and 6 illustrate orthogonal transducers.
Figure 6:
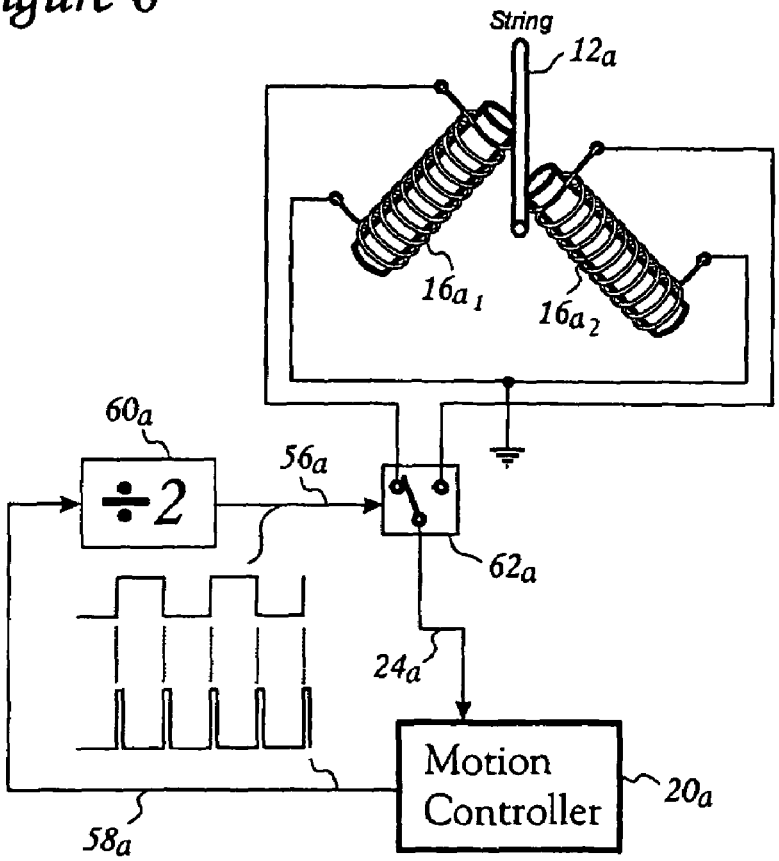

FIGS. 5 and 6: Dual Orthogonal Control System for Each String

FIG. 5 shows two orthogonally arranged unitary transducers 16*a*1 and 16*a*2 coupled to a string and displaced along the string so that their fields do not combine. As such transducers interact only with vibrations normal to the plane of the sensing surface, this arrangement of two transducers provides control of vibration that is independent of the plane of vibration.

Each transducer is coupled to a separate unitary control system. Controller 20*a*1 interacts with the string on one plane of vibration while controller 20*a*2 interacts with the string on a second orthogonal plane of vibration. The two controllers compose a force vector that matches the actual plane of vibration of the string.

FIG. 6 shows an alternative implementation of dual transducers. A switch 62*a* connects the first and then the second unitary transducer to a single control system 20*a* during alternate time frames. Time frame marking pulse 58*a* from within controller 20*a* is divided by 2 in block 60*a* and the resulting control signal switches controller 20*a* transducer connection 24*a* alternately at alternate time frames.

Figure 7:
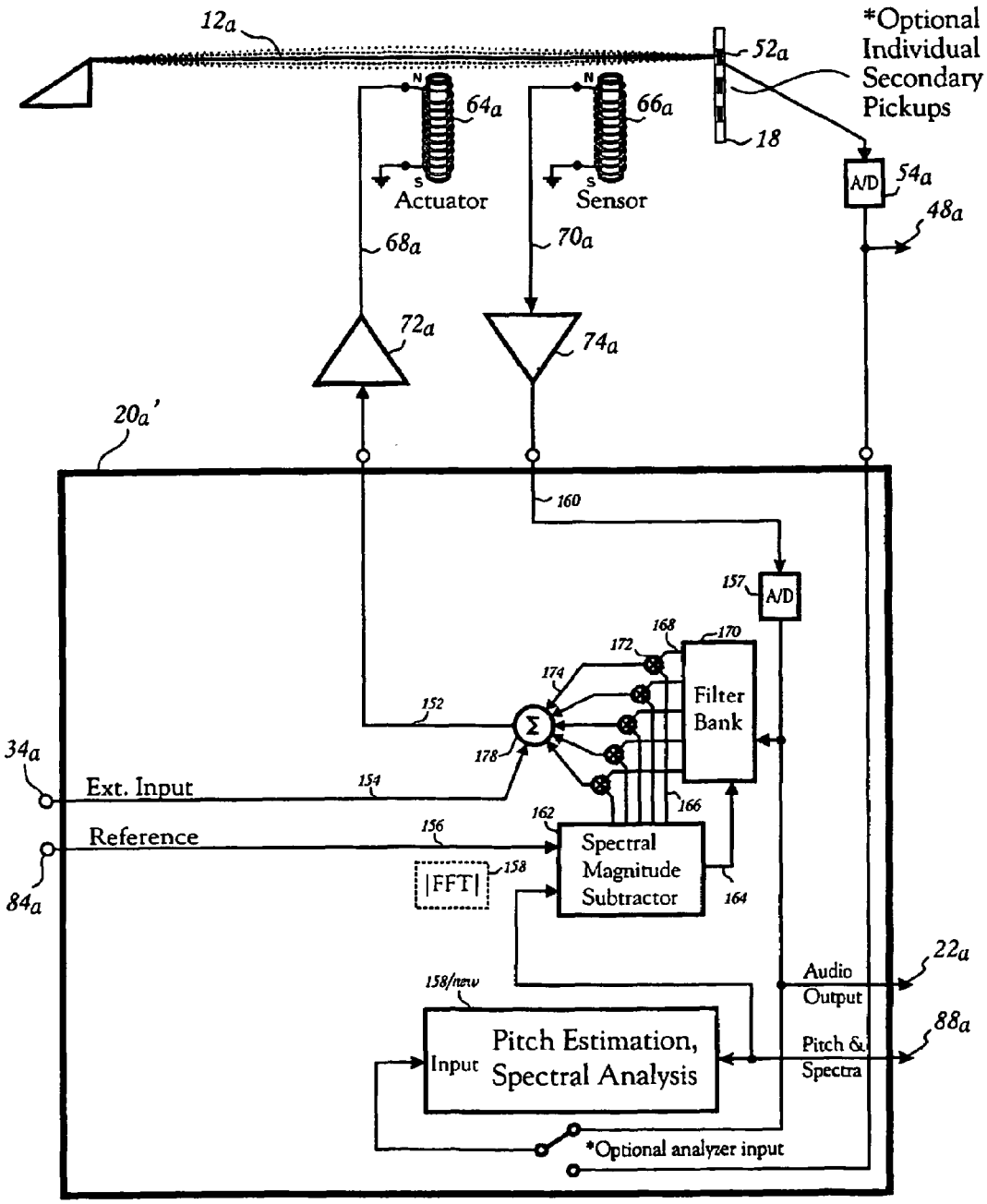
FIG. 7 illustrates a motion controller configured to attach to a simple sustainer system.

FIG. 7 Use with Sustainers

FIG. 7 is a derivation of FIG. 4 modified for use with sustainer technology and shows a modified motion controller 20*a*' interfaced with separate actuating and sensing transducers interacting with string 12*a*. The subsystem of FIG. 7 applies equally to all strings 12.

It is also within the scope of the instant invention that transducers 64 and 66 could be widened to encompass more than one string 12. Such a system would be less expensive as it might have only one or two motion controllers 20, but still capable of useful sustain effects.

Within block 20*a*' of FIG. 7, all components directly supporting the unitary transducer of FIG. 10 of the '059 patent have been removed. What remains within block 20*a*' are those aspects of a motion controller 20 that comport with a conventional sustainer system. Outside of block 20*a*', separate sensing and actuating transducers and amplifiers 66*a*, 64*a*, 72*a* and 74*a* have been added.

Sensing transducer 66*a* develops an electrical signal 70*a* analogous to the motion of string 12*a*. Said signal is amplified by 74*a* and becomes sensor output signal 160.

As described in the '059 patent, a spectral control loop operates to generate a correction signal 152 which, after amplification by drive amplifier 72*a*, is applied as signal 68*a* to a separate actuator 64*a* where it interacts electromagnetically with a ferrous string 12*a*.

Such use with sustainers employs the other novel aspects of the instant invention whereby technique command signals derived from the string's motion cause adjustments to the actuator signal affecting string motion. As the sustainer does not have the precision or the damping capability of the '059 patent, embodiments that depend on muting and precise control of timbre are not possible when using basic sustainer technology. However, it is still possible to use the magnitude of a vibrato or glissando technique commands to control the amount of sustain. Manipulation of the filter bank transfer functions will still produce interesting harmonic effects. It is much as if one had a car with a gas pedal but without brakes; such a car would still be capable of transportation, but its practical utility would be considerably lessened.

It is possible to increase the precision of control and some degree of damping within a string motion control loop having a separate sensor and actuator. The circuitry and software objects of block 20*a*' provide for virtually any feedback method in the control loop. An improvement to basic sustainer technology is made by combining said block 20' with advanced but known adaptive and adaptive-predictive control technology. Such control system methods are described in U.S. Pat. No. 6,662,058, "Adaptive Predictive Expert Control System", U.S. Pat. No. 5,426,720, "Neurocontrolled Adaptive Process Control System", and U.S. Pat. No. 5,361,303, "Frequency Domain Adaptive Control System" and these patents and their references are included herein by reference. It is to be noted that adaptive method require time for convergence, burden computational resources and require more hardware and transducers than the control system of the '059 patent.

U.S. Pat. No. 6,610,917 ("'917 patent") lists most of the known possibilities of the art but fails to mention, specify or describe the invention of identifying and measuring vibrato and glissando in the motional pitch signal of a string(s) nor of using the resulting vibrato and glissando signals as commands to effect changes in the timbre or amount of sustain of said string(s). Unlike the '917 disclosure, the instant invention identifies the superior utility of these particular possibilities from within other less useful possibilities and describes specific means and methods necessary for their reduction to practice.

Figure 8:
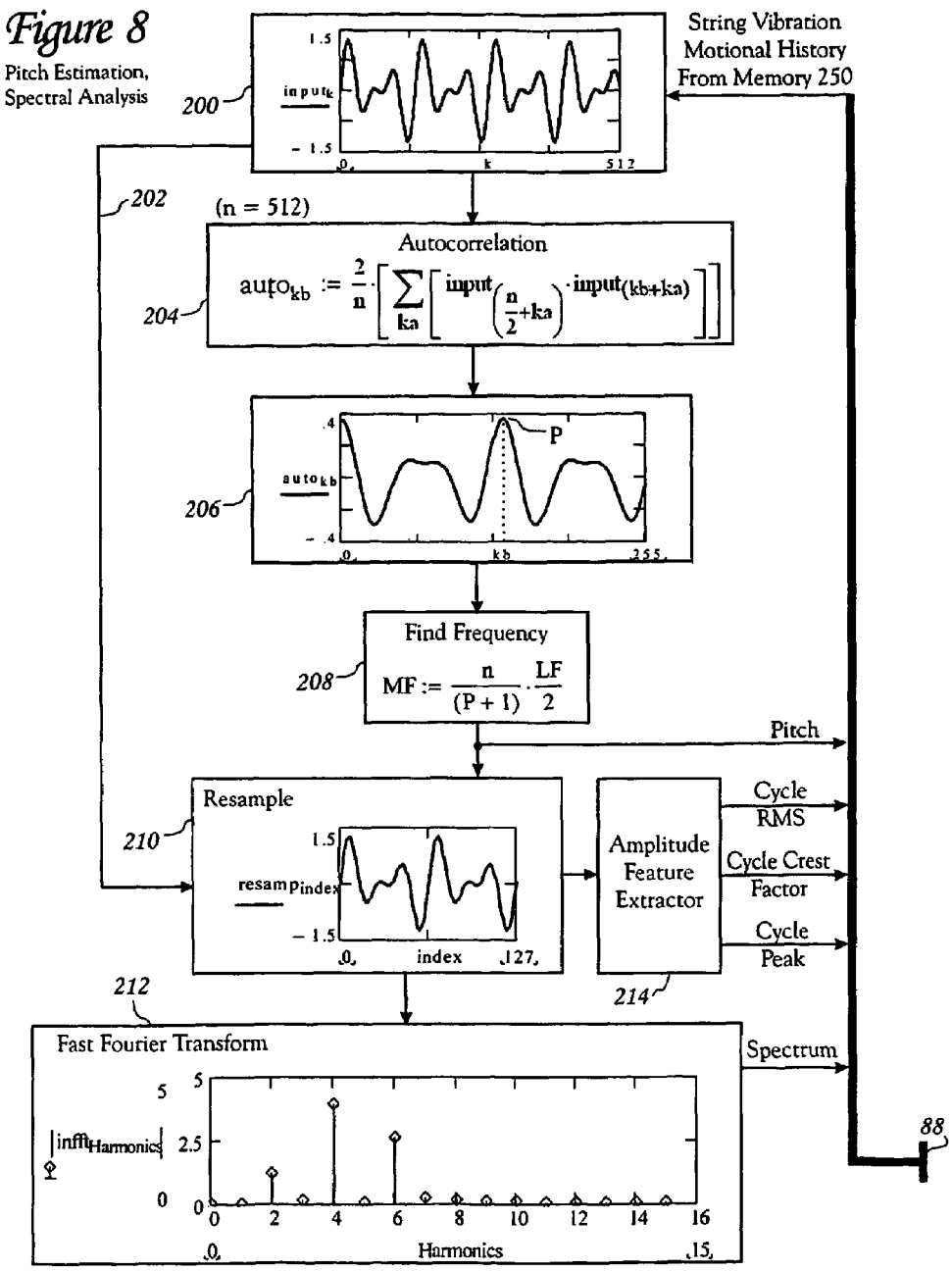
FIG. 8 shows details of pitch estimation and spectral and amplitude feature extraction.

FIG. 8: Pitch Estimation and Spectral Analysis

Within all motion controllers 20 is a block labeled 158 new that performs pitch estimation and spectral analysis, (PESA). The method to be described is computationally intense but very fast and suitably accurate.

The input to the PESA process is the most recent history of time-domain string motional data 200 continuously recorded within memory 250 (FIG. 9). The span of waveform history data 200 must contain at least two complete cycles of the expected lowest frequency fundamental of string vibration, and is determined by the range of the stringed instrument. From said motional data 200, PESA extracts pitch and spectral feature signals and sends them to memory 250 over data path 88.

Waveform 200 is representative of typical waveforms derived via pickups from string vibration. The software program "MathCad" was used to generate the graphs shown according to the calculations of the PESA process. Process 204 performs auto correlation of the first half of data 200 against the last half of data 200 and generates data 206. The variables ka and kb are index vectors with range=(0 . . . (n/2−1)), and n=512 in the example and is dependent upon the sample rate in practice.

Process 208 searches through data 206 for a point 'P' representing the index of location of the peak of correlation in data 206. The fundamental frequency, (pitch), is given by the expression, where n=the number of points in the data set and LF=the frequency corresponding to the last point. Process 210, having knowledge of the fundamental, resamples the original data 200 to fit exactly two cycles of the fundamental within a convenient radix-2 FFT input record. This is done so there is no spectral "bleeding", so that a perfect short FFT can be executed on the data.

Process 212 executes a radix-2 FFT on the resampled data and produces a spectrum of harmonic magnitude versus frequency. The first datum is 0 Hz or DC and is not of interest. Since two cycles of the first harmonic were fit to the FFT, only even numbered harmonics can be valid. If the value of odd-numbered harmonics exceeds a prescribed threshold, it indicates an error in the pitch estimate, i.e., what was thought to be two cycles of the fundamental wasn't, and therefore there are unexpected harmonics in the FFT. In the instance of such an error, pitch and spectral output data are ignored and the previous values are substituted.

A spectrum feature data signal is assembled by taking the even-numbered points of FFT magnitude data. Ideally, the PESA process is redone for every new motional sample datum, i.e., once each time frame. This stream of pitch and spectral data is stored to memory 250 via data path 88 for use by other processes. One of ordinary skill in the art will recognize opportunities for improving the efficiency of the PESA algorithms in this context with little impact on the quality of results.

A process 214 performs amplitude feature extraction and provides the cycle RMS, the cycle crest factor, and the cycle peak of the associated string vibration as outputs to path 88. This is conveniently done here using the two exact cycles of data result of process 210. The averaging operation in the RMS calculation is performed across exactly N cycles of the waveform. An N of 2 is appropriate. Similarly, the peak value of the waveform occurring over N cycles, and the crest factor, which is the cycle peak divided by the cycle RMS, are calculated for N cycles of fundamental.

A discussion of other suitable methods of pitch detection is found in an article entitled "High Accuracy and Octave Error Immune Pitch Detection Algorithms" by M. Dzuibi'Nski and B. Kostek, Multimedia Systems Department, Gda'nsk University of Technology, Narutowicza 11/12, 80-952 Gda'nsk, Poland. Background to the art of spectral analysis is found in Chapter 1 of DAFX and also pgs. 350-357 of DAFX. Almost any method of pitch estimation and spectral analysis will serve to put the fundamentals of the instant invention to practice, but preferred embodiments will benefit from fast and accurate methods.

Non-Locality of Components

The invention anticipates various combinations of subcomponents including but not limited to user interface components, transducer components, control components, supervisor components and guitar-like instrument components. For practical reasons some of these will be located in close proximity, i.e., will be a part of the instrument invention in the physical sense, while others may be more arbitrarily located but will still be a part of the instrument invention in the functional sense. For example, in light of current communication technology it is obvious that the supervisor and/or the controller subcomponents or computational portions thereof could communicate with the physical instrument by means of a high speed long distance data communications medium and thus might be located anywhere from a few feet away to many miles away from the instrument itself. All such functional combinations, whether physically grouped at the instrument or not, are subsumed under the intent and scope of this invention.

Detailed Description of the Supervisor System

FIG. 9, "Supervisor System Diagram"

Objects and processes that occur repeatedly according to the number of strings are shown as such through the artistic device indicated at 76. The structure presented in FIG. 9 is realized through software running on any suitable physical computing subsystem. FIG. 9 illustrates one possible such software. It is understood that the same functionality can be realized using different but functionally equivalent software structures and all such alternative structures are encompassed within the scope of the present invention.

Subsystem block 78 is understood to contain whichever of FIGS. 4, 5, 6, and 7 or combinations thereof that comports with the intended embodiment of the instant invention. Block 78 presents a consistent interface of motion controllers 20 to the rest of FIG. 9. Within each motion controller 20 there is a filter bank, a set of multipliers and a spectral magnitude subtractor, referenced in the original FIG. 10 of the '059 patent as 170, 172, and 162, respectively. Mixer 26 and waveform server 36 are discussed previously with respect to FIG. 1.

Supervisor 30 controls all parameters of these processes including the selection of filter bank functions, i.e., bandpass, all-pass, simple gain or polarity inversions, etc., and can also read all register states including the results of spectral subtractions. Within supervisor block 30, FIG. 9 shows a number of process activities, each having a bi-directional interface to memory 250 that serves both as data storage and as an inter-process communications medium. The immediate and historical results of any process are available to all processes through memory 250. This basic architecture is of a type known in the field of computer science to provide for efficient execution of several concurrent synchronous or asynchronous processes that must freely intercommunicate. Any other architecture known in computer science can be substituted, provided it supports the required activities of the invention.

Memory system 250 provides both private and public memory to each process and facilitates inter-process communications. Memory 250 provides at least enough space to maintain circular memory buffers containing current history of all processor outputs sufficient to serve the requirements of the invention. Ideally, memory 250 would be large enough to record all aspects of several entire musical performances.

Processes

In the embodiment herein described, all processes receive input data by accessing it within memory 250 and all processes record their output data within memory 80. The inputs and outputs of processes as well as all control signal inputs shall all be normalized in range and expressed in common terms of magnitude so that any output data of any processor will be appropriately scaled to fit within the permitted input data range of any process or control signal input.

Unless stated otherwise, all processes are best executed once during each time frame of motion controller 20, as this provides the best performance. If constrained by available computing bandwidth, most processes can be executed less frequently without much sacrifice of performance.

A software engineer experienced in writing digital signal processing software would commonly be aware of useful additions, alternatives and modifications to the algorithms described herein. For example, it might improve accuracy to discard a pitch history datum if it diverges excessively in value from its adjacent data. Such well-understood details of digital signal processing are non-proprietary workshop matters of implementation that are not detailed herein for clarity and brevity.

Earlier processes extract primary features of vibration such as pitch and amplitude. Later processes recognize and measure technique commands, which are derived by reviewing said primary features using a variety of analytic and rule-based methods. Techniques subject to recognition are those that have been preselected during the manufacture of the system of via a set-up utility.

In DAFX, Section 9.4, and portions of Chapters 10 and 12 discuss relevant processing techniques and even provide specific programming examples.

Spectra Server

Spectra server 256 governs the spectral control loop of motion controllers 20 by providing and progressively updating reference spectra from memory 250 over data path 254 according to the command interpreter as will be described.

Spectral Balance Process

A spectral balance process 258 extracts a technique command from string vibration spectra as a spectral centroid datum indicative of the balance of energy between high and low harmonics of the spectra. Suitable formulae are presented at DAFX, pgs. 362-363.

Vibrato Technique Recognition Process

A vibrato technique recognition process 260 is illustrated in FIG. 10.

Glissando Technique Recognition Process

Figure 11:
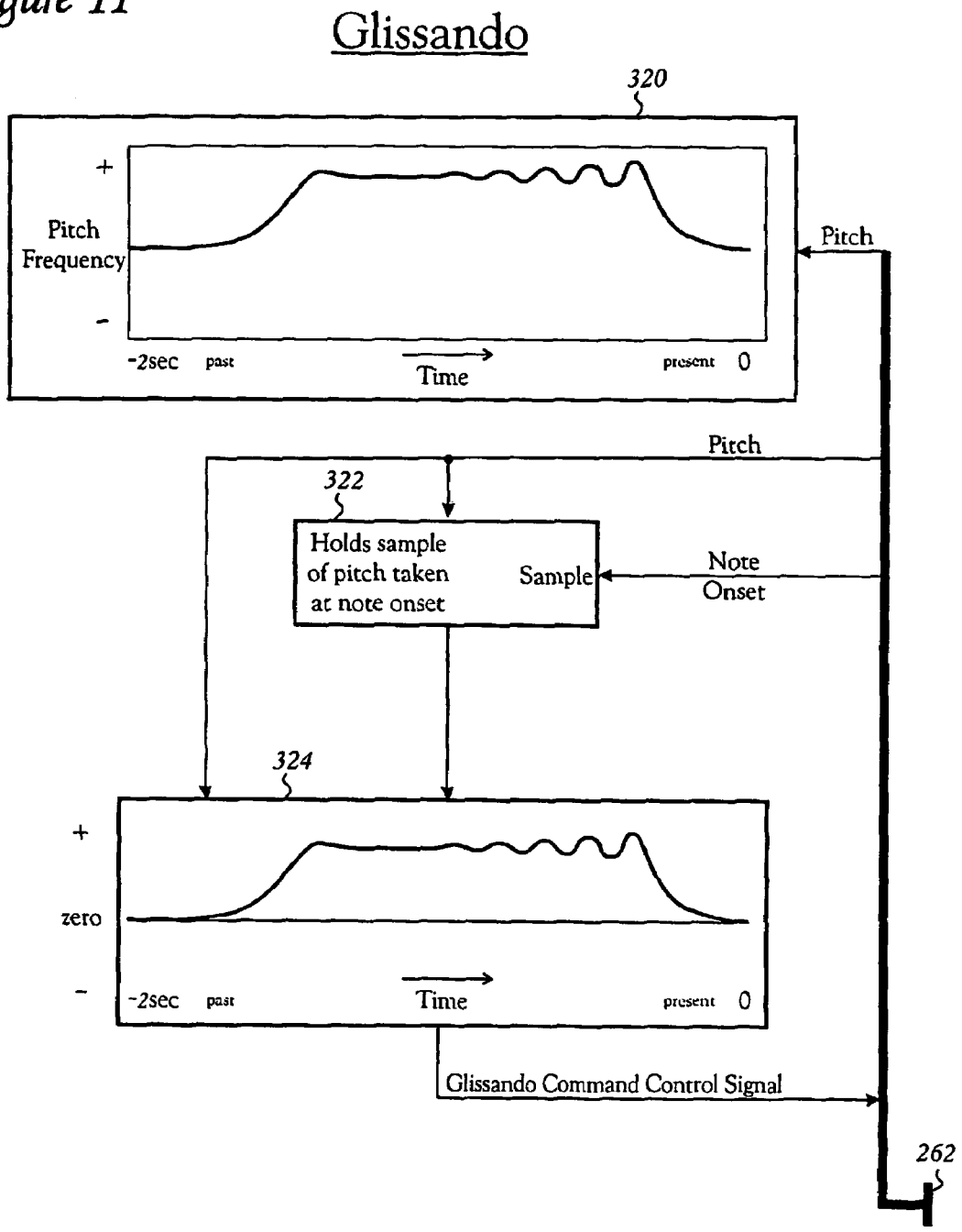
FIG. 11 is a graphic depiction showing the glissando technique recognition process.

A glissando technique recognition process 264 is illustrated in FIG. 11.

Note Onset Command Detecting Process

Figure 12:
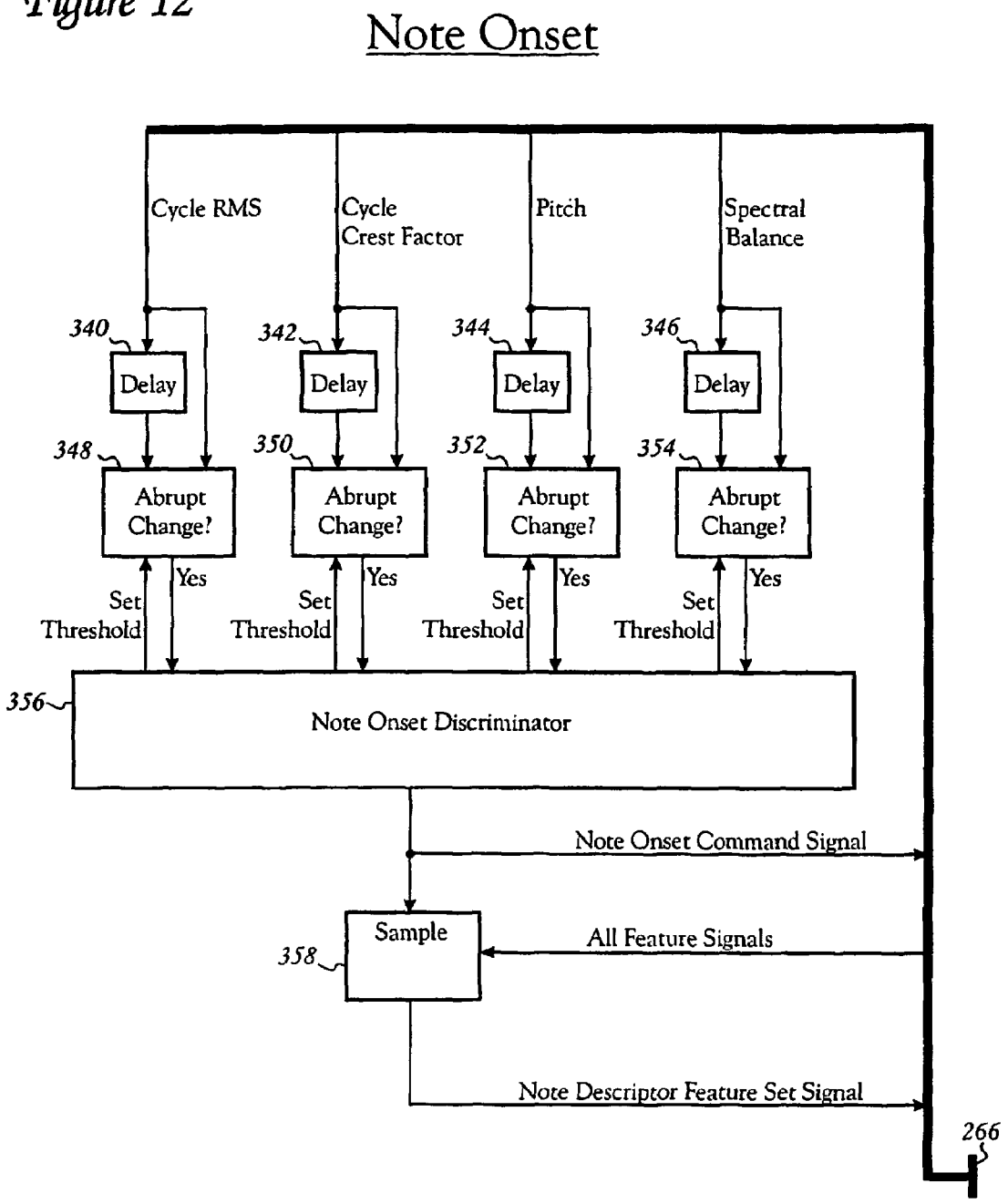
FIG. 12 is a block diagram showing the note onset technique recognition process.

Process 268 for detecting new notes is detailed in FIG. 12.

Muting Recognition Processes

Figure 13:
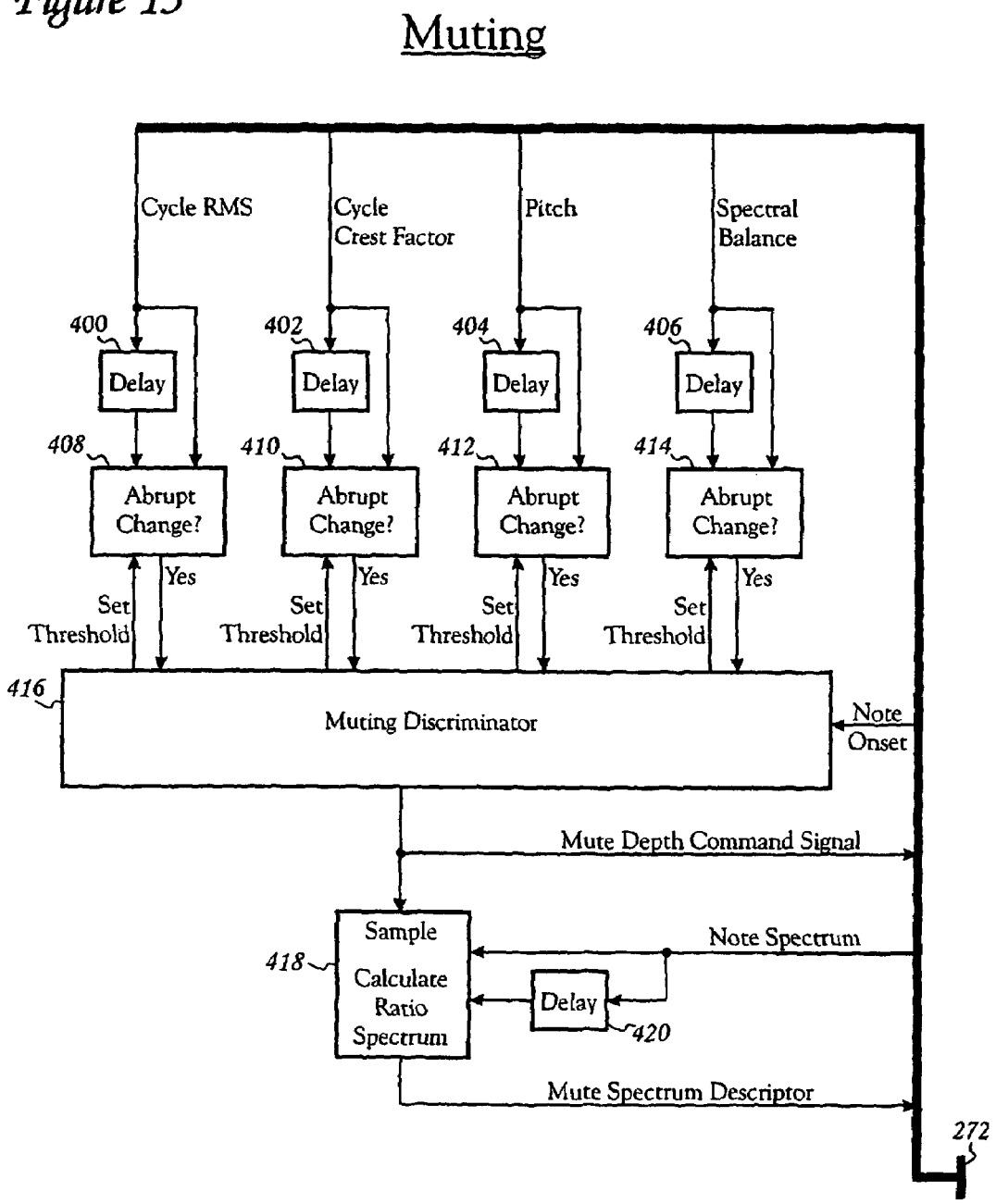
FIG. 13 is a block diagram showing the muting technique recognition process.

When the guitarist purposefully causes notes to become quieter, he has given a mute command. A muting process 270 reviews various extracted features and recognizes such muting technique as an intentional command. FIG. 13 details a muting recognition process.

Last String Played Process

Last string process 274 looks at the note onset signals from all strings and returns to memory as a datum the index of the string that was played last.

A last string played facility is described in U.S. Pat. No. 3,813,473 ("'473 patent"). According to the '473 invention means are provided for selecting only a string signal that is above a threshold and of attenuating all remaining string signals. However, in the '473 patent, attenuation is achieved electronically and the strings' vibrations are not actually damped.

The instant invention has a mode where only the last string played is permitted to vibrate while the rest of the strings are actively damped.

Phrase Recognition Process

The phrase recognition process 276 inputs the pitch signals for all strings and the note onset signals for all strings. It compares a stored database of musical phrases against phrases the musician is actually playing. When it finds a match, it issues a phrase index datum.

There is a single physical mode switch that permits this datum to be read and interpreted as a user mode command. In this way, a single physical switch, used in combination with note sequences of any length including 1, enables the instrumentalist to control an unlimited number of modal aspects of his instrument including replacing one instrument definition with another.

Processes 278, 280, 282 and 284 communicate with each other and memory 250 over path 286.

Command executive process 280 communicates over data path 286 and defines and operates the relationship between technique commands and motion control system inputs. The command executive interprets an instrument definition in terms of this relationship and is detailed in FIG. 14.

Instrument Definitions

Storage area 278 retains instrument definitions. Master program 282 selects which instrument definition is made active within command executive 280.

Master Program

Master program 282 is responsive to modal inputs such as mode selection signals from the phrase recognition process, from manual controls 14 over signal 38, and from the Aux UI 80 and digital interface 82 via communication interface 284.

Master program 282 determines the mode of the invention by activating a selected instrument definition. Master program 282 also manages software updates and has the capability to replace an portion or all portions of software with replacement software provided over digital interface 82.

Communication interface 284 supports the communication protocols utilized in the invention such as 1394, TCP/IP, USB, etc. The addition of appropriate connectors and physical layer components needed to support the chosen protocols is understood.

FIG. 10, Vibrato Process

Data path 252 provides the current pitch and recent pitch history 300 to each vibrato process 260. The historical span must be long enough to contain at least one full cycle of undulation. Two seconds are shown in FIG. 10 to illustrate both increasing and decreasing vibrato.

Process 302 tracks the peak-to-peak pitch change. The maximum pitch excursion per cycle of vibrato by sampling the pitch frequency on every negative zero crossing of the derivative of pitch (dp/dt). The corresponding minimum pitch is sampled at every positive zero crossing of dp/dt.

By counting the number of times per second that the pitch signal crosses its own average, then dividing by two, the frequency of the modulation of the pitch signal is measured and provided to path 252 as a vibrato rate command.

Process 304 maintains a running average or filtered pitch value. The average or filter state is reset by the note onset command and preloaded to the first measured pitch of the new note. The vibrato command magnitude is calculated by process 306 using (normalizer)*(max pitch—min pitch/average pitch) and is smoothed by a short-term running average. The "normalizer" is a scaling term to make the range comport with the ranges of other control signals.

FIG. 11, Glissando Process

A glissando process requires the most current pitch and the note onset command as inputs. Data path 262 provides this and all communication with memory 250.

Waveform 320 is displayed in the figure to illustrate an example of how pitch changes in response to a player's glissando technique. Here, the guitarist "pulls" his string up a tone, adds vibrato to the pulled note, and then allows the note to fall back.

A process 324 calculates the running glissando magnitude by subtracting the most current pitch value from a note onset pitch value held by sampler 322. Sampler 322 is gated by note onset commands. The resulting glissando command signal is normalized in scale to other control signals and sent to memory 250 via path 262.

FIG. 12, Note Onset Detector Process

Inputs to each note onset process include the most recent pitch, spectral balance, cycle RMS and cycle crest factor feature signals.

Delays 340, 342, 344 and 346 delay each such input by an amount of time that yields meaningful comparisons. Delay values of a few milliseconds would serve for all.

Threshold comparators 348, 350, 352 and 354 compare the ratiometric difference between current and delayed magnitudes of said feature signals against prescribed thresholds. If the resulting percentage increase or decrease of any feature signal exceeds its threshold, a datum representing the change percentage is delivered to discriminator 356.

Note onset discriminator 356 is a process that uses rules to test weighted combinations of said change percentage data against prescribed thresholds to determine if the instrumentalist has deliberately started a new note. For each rule, discriminator 356 sends a new set of thresholds to comparators 348, 350, 352 and 354.

One such rule would be, "If the pitch has changed by more than a semitone, issue a Note Onset command." Another such rule would be, "If the Spectral Balance and Cycle Crest Factors have shifted upwards but the Cycle RMS remains almost unchanged, issue a Note Onset command only if Pitch has been perturbed."

When a new note is recognized, discriminator 356 sends or updates on path 266, a note onset command signal that preferentially has the form of an up counter where 0 indicates the onset of a note and where the numeric progress of the counter indicates the time length of the note. A note onset command value of zero is used for synchronizing activities to notes by several other processes.

At the instant of note onset, feature sampler 360, connected to memory 250 via path 266, samples all features extracted from string vibration. This creates and stores to memory 250 a note descriptor signal that is the set of feature signals current at the time of note onset.

FIG. 13, Muting Process

The inputs and operations of the muting process are almost identical to those of the note onset process. Delays are provided as 400, 402, 404 and 406. The threshold comparators are 408, 410, 412 and 414. The rules, thresholds, delays and outputs are different.

Some of the rules of the mute recognition algorithm are, "If the pitch has not changed and Cycle RMS is lower and the spectral balance has tilted down, issue a Mute Depth command", and "If the Cycle Crest Factor falls rapidly after a Note Onset and the Cycle RMS is declining, issue a Mute Depth command."

The output of muting discriminator 416 is a mute depth technique command signal representative of the amount or "urgency" of the muting extracted for the associated string, and a mute spectrum descriptor.

A note onset command received on path 272 clears all mute process output signals.

Process 418 makes ratiometric comparisons of a past note spectrum as provided by delay 420 and a present note spectrum, to create a mute spectrum descriptor. An updated mute spectrum descriptor is sent to memory 250 on path 272 whenever the mute depth signal causes process 418 to sample the descriptor.

The mute spectrum descriptor indicates which harmonics were suppressed during the player's muting of the string and which were not.

The significance of the mute spectrum descriptor is made greater by the other virtues of the invention. For example, by touching the string at nodes of selected harmonics, the player will mute other harmonics save the selected one. If he is also applying sustain-inducing vibrato, the selected harmonic will rise out of the note.

FIG. 14

Figure 14:
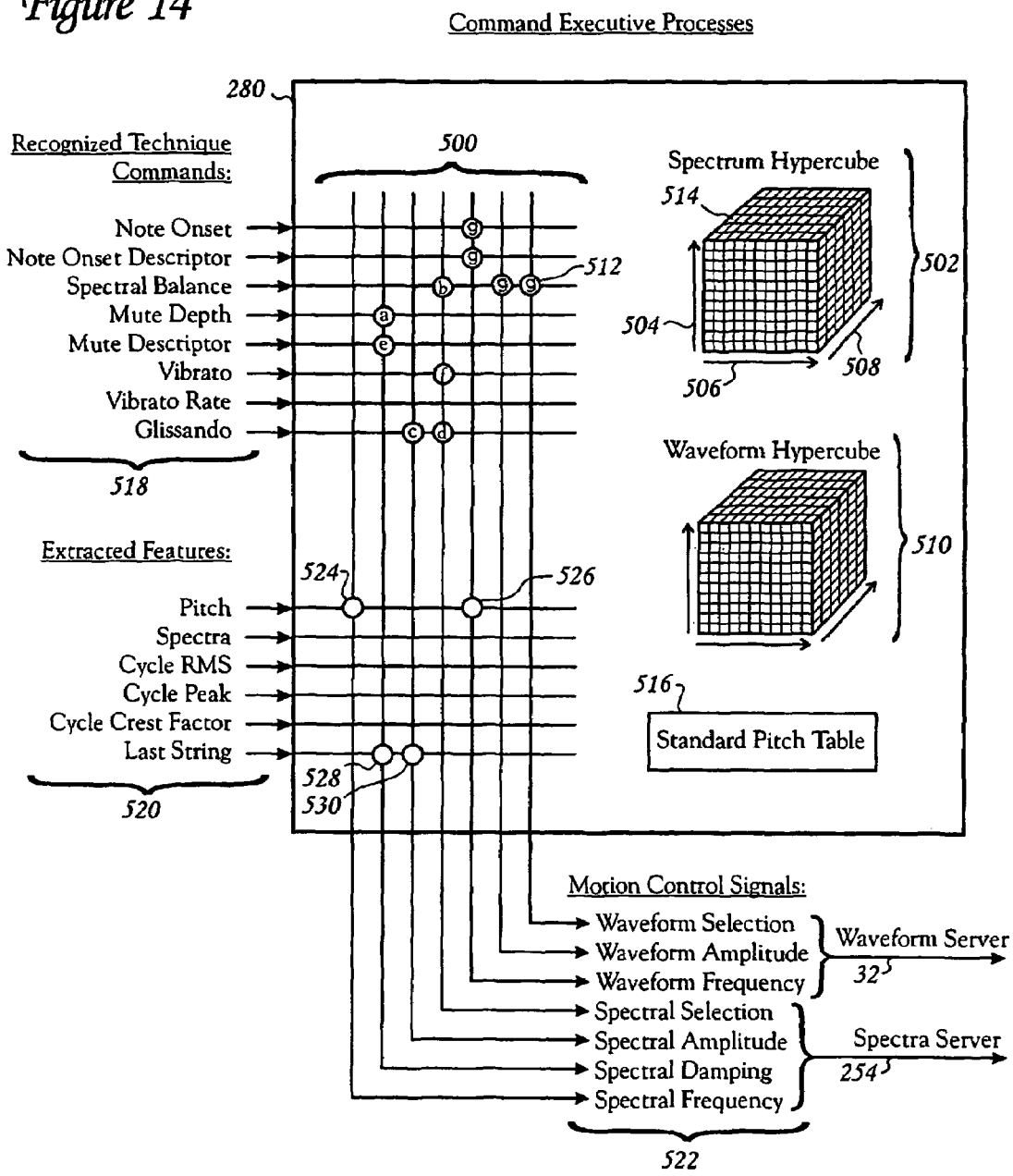
FIG. 14 illustrates a simplified matrix of the command executive process.

FIG. 14 shows command executive 280 brings together all the technique commands and feature signals that have been explained herein.

The Motion Control Signals output by Executive 280 are:

Waveform server control signals for selecting and setting attributes of waveform reference signals output by waveform server 36 as signal 34, (see FIG. 9), Spectra server control signals 254 for selecting and setting attributes of spectral reference signals output as signal 84 by the spectral server, (see FIG. 9).

Mapping matrix 500 presents cross points between input commands and features 518 and 520, and output motion control signals 522. Horizontal signal lines are inputs while vertical signal lines are outputs. Motion control signals 522 pass on path 286 to memory 250 and then to paths 32 and 254.

At selected cross points, a script such as script 512 is installed to execute as a continuous sub-process and several scripts can execute concurrently. The active instrument definition determines what scripts are installed and where. Said script is a software code that defines the relationship between the input control signal and the output control signal of the matrix. Any imaginable relationship can be defined, and the script can access other signals to create composite responses.

Alternative means for achieving substantially the same functionality include, but are not limited to, evolutionary algorithms, neural networks and other such architectures and method that are trainable and/or self-organizing. Such a system would connect to all inputs and outputs shown on FIG. 14, but would require an additional training input to be accessed by a manufacturer during a training process. For example, to train such a system to respond to vibrato by increasing sustain, one would expose the learning network's FIG. 14 inputs to feature signals and technique commands characteristic of vibrato, and one would provide the training input with feature signals characteristic of sustained string motion as the desired result. Once trained, the supervisory system responds to vibrato with sustain. The result of such an approach will still be, in essence, a rule-based system, but the rules will have been generated and recorded within the supervisor by the software itself, not supplied by a human designer.

These means and any other known means of establishing a complex relationship between one or more input signals and one or more output signals such that provides the functions of FIG. 14 falls within the instant invention's scope.

Spectrum hypercube 502 is shown having three dimensions 504, 506 and 508 but it could have more. It illustrates how several control signals can act together to select a unique spectral reference signal from stored spectra. Note that in the example matrix 500, three scripts b, f and d are all governing the spectral selection control signal. If spectral balance controlled the 504 axis, vibrato controlled the 506 axis and glissando controlled the 508 axis of spectrum hypercube 502, a unique spectrum would be selected for every quantized step of each control signal.

Waveform hypercube 510 works just as the spectrum hypercube 502 in selecting waveforms according to several control signal inputs.

Standard pitch table 516 is present to enable the tuning of the instrument to be pulled towards a standard tempered scale by the action of motional feedback. This would be done if scripts 524 or 526 called for it.

If in arpeggio mode, scripts 528 and 530 would mute all but the last string played.

Some matrix scripts such as 512 are shown with a letter enclosed in a circle. Said letter corresponds to the instrument definition example given below and shows how the matrix can be used to interpret an instrument definition:

An Example of an Instrument Definition:

(a) Open strings sounding below 20% of the average string amplitudes shall be held mute by electronic damping.

(b) The spectral balance of a string's vibration shall select spectral references from a set of spectral references indexed by the control signal.

(c) Pulling a string so that the note rises in pitch shall increase sustain amplitude.

(d) Pulling a string, plucking it, and then slowly reducing the tension to lower the pitch of the note shall cause the note's second harmonic to increase in amplitude and the first harmonic to decrease in amplitude.

(e) A sudden decrease in string amplitude, (as by hand muting), shall enable electronic damping of that string.

(f) If the player applies vibrato to one or more notes in a chord, the chord shall be sustained and a predetermined series of harmonics shall be evoked within the vibrations of the strings making up the chord.

(g) If the player plays very close to the bridge of his instrument, each manual plucking of a string shall elicit a series of rapid electromagnetic "plucking" actuating events upon that string.

The preceding example is but one of an endless series of instrument definitions made possible by the invention. Some definitions will find more favor with musicians than others, but all such definitions fall under the scope and intent of the invention. The invention does not have one fixed behavior, instead, much as a computer is an invention that allows many different programs to be written by programmers and executed on the same computer hardware, the invention allows for many variations of instrument to be defined by instrument designers. Thus various different manufactures of instruments employing the instant invention can differentiate their offerings according to their design choices, while using a standardized hardware embodiment of the invention produced inexpensively in high volume.

The invention claimed is:

1. A system for controlling and modifying vibratory motion of at least one string of a stringed musical instrument comprising:

a) transducer means associated with at least one string for providing a sensing signal representative of vibratory motion of the string and for applying a force to said at least one string in accordance with an actuating signal;

b) at least one motion controller associated with said transducer means and responsive to said sensing signal to form said actuating signal for selectively damping and/or exciting the vibratory motion of the string or selected harmonics thereof; and c) user control means to provide control over the behavior of said at least one motion controller wherein said transducer means comprises at least one unitary sensing/actuating transducer arranged to produce during a first portion of a time frame the sensing signal representative of string motion and to apply during a second portion of said time frame an actuating force to said at least one string in accordance with the actuating signal; and wherein said at least one motion controller is arranged to respond to said sensing signal during said first portion of said time frame and to provide said actuating signal during said second portion of said time frame for selectively controlling the vibratory motion of the string over a succession of said time frames.

2. The system of claim 1 wherein said transducer means further comprises at least one sensing transducer for providing the sensing signal and at least one separate actuating transducer for applying a force to said at least one string in accordance with the actuating signal; and wherein said at least one motion controller comprises an adaptive control system coupled to said sensing transducer and to said separate actuating transducer and arranged to respond to said sensing signal and to provide and adaptively adjust the characteristics of said actuating signal to maintain control of said vibratory motion of the string.

3. The system of claim 1 wherein said at least one unitary transducer comprises first and second unitary sensing/actuating transducers arranged in an orthogonal relationship relative to the string and wherein said motion controller is switched between the first and second unitary transducer at one-half the time frame rate the first and second unitary transducers each being arranged to sense and actuate separate orthogonal components of the vibratory motion in more than one plane.

4. The system of claim 1 including at least one secondary sensing transducer for providing a secondary sensing output signal in accordance with the vibratory motion of at least one string.

5. The system of claim 1 further including a mixer for combining signals of the system into a composite audio output signal.

6. The system of claim 1 wherein the said motion controller is arranged to drive the transducer using a discontinuous pulse width modulator further having a pre-distorting element to correct a non-linearity of said pulse width modulator.

7. The system of claim 1 including an external input for supplying an external signal to modify the vibratory motion of said string.

8. The system of claim 1 wherein said user control means includes at least one control that is manually operable for control of system behavior.

9. The system of claim 1 wherein said at least one motion controller is responsive to a reference control signal input prescriptive of string motion and wherein said user control means includes a supervisor to facilitate player control of system behavior, said supervisor being responsive to preselected player techniques involving selected characteristic features of vibratory motion and supplying said reference control signals to said at least one motion controller.

10. The system of claim 1 wherein said actuating signal comprises a correction signal for reducing deviation of the string's vibratory motion from a desired motion.

11. The system of claim 9 wherein vibratory motion of the string undergoing a smooth changing of pitch comprises one of the preselected player techniques.

12. The system of claim 11 wherein the supervisor is arranged to cause the motion controller to provide the actuating signal that modifies the vibratory motion of the string in accordance with a measurement of vibrato.

13. The system of claim 12 wherein said measurement is of the magnitude of pitch change due to vibrato and said modification to motion comprises exciting and sustaining string vibration according to said magnitude of vibrato.

14. The system of claim 11 wherein the supervisor is arranged to cause the motion controller to provide the actuating signal that modifies the vibratory motion of the string in accordance with a measurement of pitch change due to glissando.

15. The system of claim 9 wherein the supervisor is arranged to cause the motion controller to provide the actuating signal that modifies the pitch of string vibration.

16. The system of claim 15 wherein said pitch modification substantially corrects the pitch to conform to a standard pitch.

17. The system of claim 9 wherein amplitude of vibratory motion comprises one of the preselected player techniques.

18. The system of claim 17 wherein a string undergoing motion having amplitude above a threshold causes the supervisor to cause the motion controller to provide an actuating signal to excite and modify the string's vibratory motion and a string undergoing vibratory motion having amplitude below a threshold causes the supervisor to cause the motion controller to provide an actuating signal to damp the string's vibratory motion.

19. The system of claim 18 wherein said threshold is dynamic and derived from an averaging of one or more string vibratory amplitudes.

20. The system of claim 9 wherein a motion of the string creating a new note comprises one of the preselected player techniques.

21. The system of claim 20 wherein the supervisor is configured cause the motion controller to modify the vibratory motion producing the most recent note played and to damp other string vibrations.

22. The system of claim 9 wherein the vibratory motion of the string creating a new note having a given spectrum comprises one of the preselected player techniques.

23. The system of claim 9 wherein the vibratory motion of the string creating one or a series of new notes of specified pitch comprises one of the preselected player techniques.

24. The system of 23 having a user selectable mode wherein occurrence of a preselected one or a series of new notes causes the supervisor to activate a corresponding instrument definition obtained from several stored alternative instrument definitions each instrument definition prescribing a separate behavior of the instrument.

25. The system of claim 9 having a mode wherein sympathetic vibrations occurring on unplayed strings are damped.

26. The system of claim 9 wherein the vibratory motion of the string being muted is one of the preselected player techniques.

27. The system of claim 9 wherein the supervisor is further arranged to record, store, access, route and process data relating to the system.

28. The system of claim 9 wherein the supervisor is provided with one or more external data connections whereby programs in the supervisor can be changed or replaced and/or for general data communications and/or for an auxiliary user-interface.

29. The system of claim 9 wherein a portion of the system comprises analog electrical circuitry.

30. The system of claim 2 wherein said at least one motion controller is responsive to a reference control signal input prescriptive of string vibratory motion and wherein said user control means includes a supervisor to facilitate player control of system behavior, said supervisor being responsive to preselected player techniques involving selected characteristic features of string vibratory motion and supplying said reference control signal to said at least one motion controller.

31. The system of claim 30 wherein a motion of the string undergoing a smooth variation of pitch due to vibrato is one of the preselected player techniques;

the supervisor is arranged to cause the motion controller to provide the actuating signal that modifies the vibratory motion of the string in accordance with a measurement of vibrato; and wherein said measurement is of magnitude of pitch change due to vibrato and said modification to vibratory motion comprises exciting and sustaining string vibratory motion according to said magnitude of vibrato.

32. The system of claim 30 wherein the supervisor is arranged to cause the motion controller to provide the actuating signal that modifies pitch of string vibration.

33. The system of claim 30 wherein an amplitude of string vibratory motion comprises one of the preselected player techniques; and wherein a string undergoing vibratory motion having amplitude above a threshold causes the supervisor to cause the motion controller to provide the actuating signal to excite and modify the string's vibratory motion and a string undergoing vibratory motion having amplitude below a threshold causes the supervisor to cause the motion controller to provide the actuating signal to damp the string's vibratory motion.

34. The system of claim 33 wherein said threshold is dynamic and derived from an averaging of one or more string vibratory amplitudes.

35. The system of claim 30 having a mode wherein sympathetic vibrations occurring on unplayed strings are damped.

36. The system of claim 30 wherein the supervisor is provided with one or more external data connections whereby programs in the supervisor can be changed or replaced and/or for general data communications and/or for an auxiliary user-interface.

37. The system of claim 30 wherein the supervisor is further arranged to record, store, access, route and process data relating to the system.

38. The system of claim 30 wherein a portion of the system comprises analog electrical circuitry.

39. The system of claim 2 wherein said at least one sensing transducer is a bridge pickup transducer.

40. The system of claim 39 wherein said bridge pickup transducer is of the piezoelectric type.

41. The system of claim 30 wherein said reference control signal input establishes a target amplitude for string vibratory motion such that vibratory motion of amplitude less than the target amplitude is excited up to the target amplitude and vibratory motion of amplitude greater than the target amplitude is damped down to the target amplitude.

42. A method of recognizing preselected player techniques in playing a stringed musical instrument and utilizing such recognized player techniques as player commands to govern the operation of at least one motion control function coupled to at least one string of said instrument comprising:

producing a sensing signal representative of the vibration of said at least one string and applying a force to said string in accordance with an actuating signal;

electronically recognizing one or more preselected player techniques; and controlling said motion controller function in accordance with the recognized player techniques to apply the actuating signal to modify the vibratory motion of said at least one string by selectively damping and/or exciting harmonic components of said vibratory motion wherein the step of recognizing preselected player techniques includes:

extracting feature signals from the sensed vibratory motion of one or more strings; and routing the extracted feature signals according to their correspondence to one or more preselected player techniques; and applying, as pre-specified functions of the types and measurements of the routed extracted feature signals, actuating signals to modify the vibratory motion of said at least one string.

43. The method of claim 42 wherein routing the extracted feature signals includes providing a set of pattern matching rules representative of features of string vibratory motion associated with the preselected player techniques, testing the extracted feature signals against said rules, and sending specific test-selected feature signals to prescribed function processors to generate control signals to govern said at least one motion control function.

44. The method of claim 42 wherein the preselected player techniques include one or more techniques in the form of amplitude of string vibration, vibrato, glissando, muting, plucking a new note of a selected amplitude, the spectrum of the new note, the spectra of a note, the harmonic balance of the new note, and one or a series of new note pitches.

45. The method of claim 42 wherein a reference signal input receives control signals prescriptive of vibratory motions that are compared against the actual string vibratory motions as provided by sensing signals representative of string vibration to generate actuating signals resulting from said comparison that create forces to compel and constrain said string vibratory motion towards an intended vibratory motion as prescribed by said reference signal.

46. The method of claim 45 wherein said reference signal derives from an external signal input to the instrument.

47. The method of claim 45 wherein said reference signal is a frequency domain representation of the prescribed vibratory motion and the comparison includes converting said sensing signal representative of string vibration to the frequency domain representation, comparing the magnitudes of spectral components of said sensing signal against those of said reference signal and generating an error signal therefrom that controls a feedback filter that forms said actuating signals.

48. The method of claim 45 including storing an array of reference signals and selecting particular reference signals from within said array according to extracted feature signals for routing to said reference signal input.

49. The method of claim 42 including storing an array of pre-specified command phrases and instrument definitions and having a player-selectable instrument redefinition mode wherein occurrence of said pre-specified command phrase comprising one or a sequence of notes causes the instrument definition to be changed accordingly.

50. The method of claim 42 wherein in a case of multiple unitary sensing/actuating transducers all sensing signals from the transducers occur during the same first time portion of a time frame and all actuating signals applied to the transducers occur during a same second time portion of said time frame.

* * * * *